US012398916B2

(12) United States Patent
Aly et al.

(10) Patent No.: US 12,398,916 B2
(45) Date of Patent: Aug. 26, 2025

(54) CONDENSATE COLLECTION ASSEMBLY

(71) Applicant: Johnson Controls Tyco IP Holdings LLP, Milwaukee, WI (US)

(72) Inventors: Amr Maher Aly, Wichita, KS (US); Xianjin Cheng, Andover, KS (US); Elmer Wayne Romero, Oxford, KS (US); D'Marcus Garrett, Wichita, KS (US); Selin Nur Ergul, Wichita, KS (US); Akshay Baljekar, Pune (IN)

(73) Assignee: JOHNSON CONTROLS LIGHT COMMERCIAL IP GMBH, Neuhausen am Rheinfall (CH)

( * ) Notice: Subject to any disclaimer, the term of this patent is extended or adjusted under 35 U.S.C. 154(b) by 228 days.

(21) Appl. No.: 18/075,133

(22) Filed: Dec. 5, 2022

(65) Prior Publication Data

US 2024/0183572 A1 Jun. 6, 2024

(51) Int. Cl.

| | |
|---|---|
| ***F24F 13/22*** | (2006.01) |
| ***F24F 1/36*** | (2011.01) |
| ***F25D 21/14*** | (2006.01) |

(52) U.S. Cl.

CPC ..... *F24F 13/222* (2013.01); *F24F 1/36* (2013.01); *F25D 21/14* (2013.01)

(58) Field of Classification Search

CPC .. F24F 1/36; F24F 13/22; F24F 13/222; F24F 2013/227; F25D 21/14; F28F 17/005

See application file for complete search history.

(56) References Cited

U.S. PATENT DOCUMENTS

| | | | | |
|---|---|---|---|---|
| 2020/0064054 | A1* | 2/2020 | Carlton | F28F 17/005 |
| 2020/0355439 | A1* | 11/2020 | Mercer | F28D 7/0066 |
| 2022/0349645 | A1 | 11/2022 | Romero et al. | |

* cited by examiner

*Primary Examiner* — Joseph F Trpisovsky

(74) *Attorney, Agent, or Firm* — Fletcher Yoder, PC

(57) ABSTRACT

The present disclosure relates to a heating, ventilation, and/or air conditioning (HVAC) system that includes a condensate collection assembly. The condensate collection assembly includes a drain pan configured to collect condensate generated by a heat exchanger of an HVAC system. The condensate collection assembly also includes a condensate capture receptacle configured to couple to the heat exchanger and overlap with the heat exchanger relative to a direction of air flow across the heat exchanger. The condensate capture receptacle is further configured to discharge condensate to the drain pan, and to be suspended above the drain pan relative to a direction of gravity.

20 Claims, 13 Drawing Sheets

CONDENSATE COLLECTION ASSEMBLY

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Environmental control systems are utilized in residential, commercial, and industrial environments to control environmental properties, such as temperature and humidity, for occupants of the respective environments. The environmental control system may control the environmental properties through control of an air flow delivered to the environment. In some cases, environmental control systems include a vapor compression system, which includes heat exchangers, such as a condenser and an evaporator, that transfer thermal energy between the vapor compression system and the environment. Fans or blowers may direct a flow of supply air across a heat exchange area of the evaporator, and refrigerant circulating through the evaporator may absorb thermal energy from the supply air. Accordingly, the evaporator may discharge conditioned air, which is subsequently directed toward a cooling load, such as an interior of a building. In some instances, the evaporator may condense moisture suspended within the supply air, and condensate may form on an exterior surface of the evaporator. The condensate is generally directed to a drain pan configured to collect the condensate generated by the evaporator. However, the air flow passing across the evaporator may displace condensate formed and/or accumulated on the evaporator. Unfortunately, the velocity of the air flow may transfer the displaced condensate to a location or region beyond the drain pan.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure relates to a condensate collection assembly. The condensate collection assembly includes a drain pan configured to collect condensate generated by a heat exchanger of a heating, ventilation, and air conditioning (HVAC) system. The condensate collection assembly also includes a condensate capture receptacle configured to couple to the heat exchanger. The condensate capture receptacle is further configured to overlap with the heat exchanger relative to a direction of air flow across the heat exchanger, to discharge condensate to the drain pan, and to be suspended above the drain pan relative to a direction of gravity.

The present disclosure also relates to a condensate collection assembly comprising a condensate trough configured to couple to a downstream end of a heat exchanger disposed within an air flow path of a heating, ventilation, and air conditioning (HVAC) system, relative to a direction of air flow across the heat exchanger. The condensate trough is further configured to capture condensate generated by the heat exchanger and to be disposed within the air flow path and offset from a drain pan of the HVAC system.

The present disclosure further relates to an HVAC system that includes a heat exchanger disposed within an air flow path and configured to condition an air flow directed across the heat exchanger. The HVAC system also includes a condensate collection assembly configured to capture condensate generated by the heat exchanger. The condensate collection assembly includes a condensate capture receptacle configured to couple to the heat exchanger and to overlap with the heat exchanger relative to a direction of air flow across the heat exchanger along the air flow path. The condensate collection assembly is further configured to discharge condensate to a drain pan disposed beneath the heat exchanger and to be suspended above the drain pan relative to a direction of gravity.

BRIEF DESCRIPTION OF DRAWINGS

Various aspects of this disclosure may be better understood upon reading the following detailed description and upon reference to the drawings in which.

DETAILED DESCRIPTION

Figure 1:
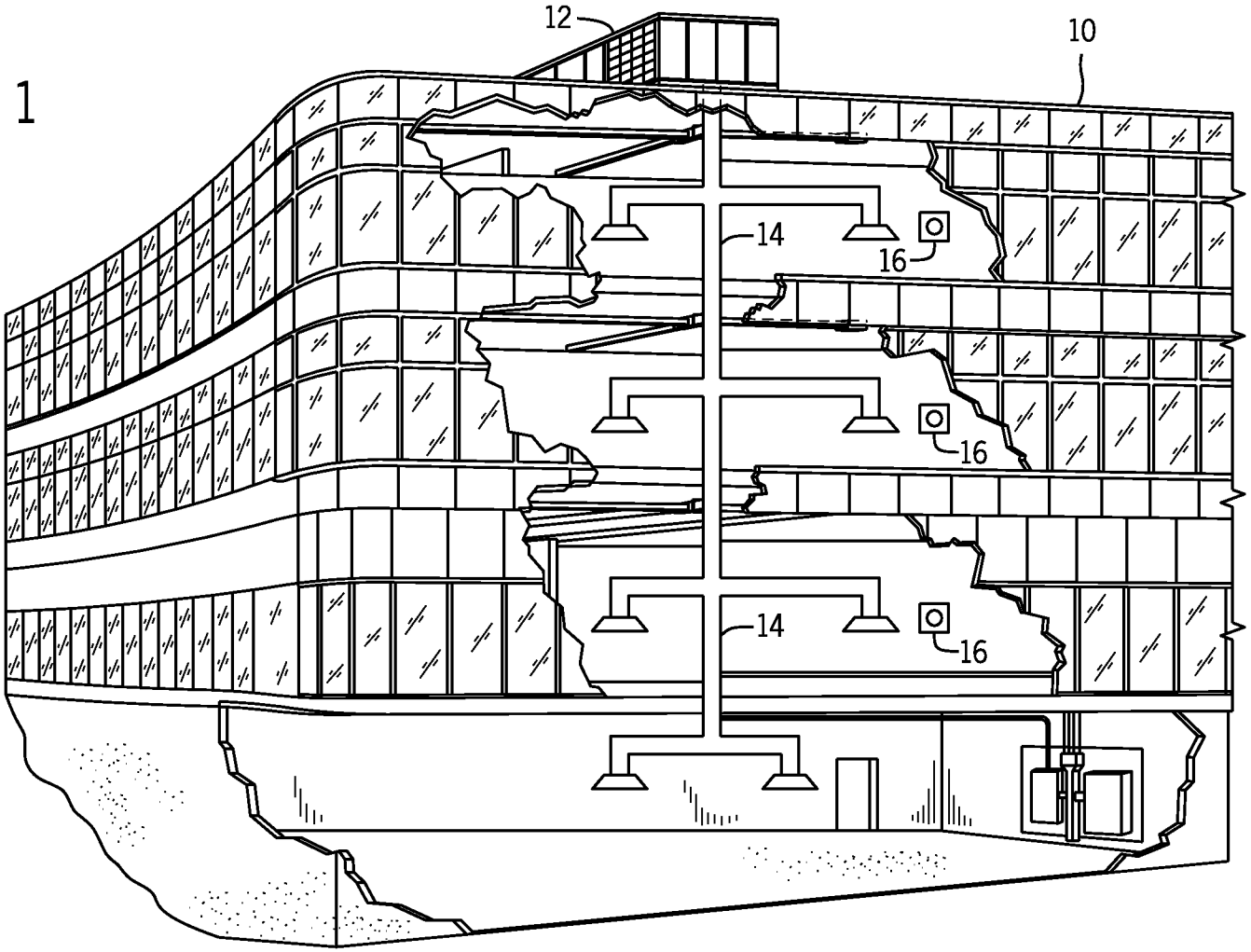
FIG. 1 is a perspective view of an embodiment of a building incorporating a heating, ventilation, and/or air conditioning (HVAC) system in a commercial setting, in accordance with an aspect of the present disclosure.

One or more specific embodiments of the present disclosure will be described below. These described embodiments are examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As used herein, the terms "approximately," "generally," and "substantially," and so forth, are intended to convey that the property value being described may be within a relatively small range of the property value, as those of ordinary skill would understand. For example, when a property value is described as being "approximately" equal to (or, for example, "substantially similar" to) a given value, this is intended to mean that the property value may be within +/−5%, within +/−4%, within +/−3%, within +/−2%, within +/−1%, or even closer, of the given value. Similarly, when a given feature is described as being "substantially parallel" to another feature, "generally perpendicular" to another feature, and so forth, this is intended to mean that the given feature is within +/−5%, within +/−4%, within +/−3%, within +/−2%, within +/−1%, or even closer, to having the described nature, such as being parallel to another feature, being perpendicular to another feature, and so forth. Further, it should be understood that mathematical terms, such as "planar." "slope," "perpendicular," "parallel," and so forth are intended to encompass features of surfaces or elements as understood to one of ordinary skill in the relevant art, and should not be rigidly interpreted as might be understood in the mathematical arts. For example, a "planar" surface is intended to encompass a surface that is machined, molded, or otherwise formed to be substantially flat or smooth (within related tolerances) using techniques and tools available to one of ordinary skill in the art. Similarly, a surface having a "slope" is intended to encompass a surface that is machined, molded, or otherwise formed to be oriented at an angle (e.g., incline) with respect to a point of reference using techniques and tools available to one of ordinary skill in the art.

As briefly discussed above, a heating, ventilation, and/or air conditioning (HVAC) system may be used to thermally regulate a space within a building, home, or other suitable structure. For example, the HVAC system may include a vapor compression system that transfers thermal energy between a heat transfer fluid (e.g., a working fluid), such as a refrigerant, and a fluid to be conditioned, such as air. The vapor compression system includes heat exchangers (e.g. a condenser, an evaporator) that are fluidly coupled to one another via one or more conduits to form a refrigerant circuit. A compressor may be used to circulate the refrigerant through the refrigerant circuit and enable the transfer of thermal energy between components of the vapor compression system (e.g., the condenser, the evaporator) and one or more thermal loads (e.g., an environmental air flow, a supply air flow).

Generally, one or more heat exchangers of the HVAC system may operate to condition a flow of air that is supplied to a conditioned space, such as interior of a building. The air to be conditioned may include ambient (e.g., outside) air, return air, a mixture of ambient air and return air, and/or another suitable flow of air. The HVAC system may include one or more fans or blowers that direct a flow of air across a heat exchange area of a heat exchanger to enable conditioning (e.g., heating, cooling, dehumidification) of the air. For example, an evaporator of the HVAC system may be configured to place refrigerant circulating through the evaporator in a heat exchange relationship with the air flow. In this way, the refrigerant within the evaporator may absorb thermal energy from the air flow, thereby cooling the air flow before the air flow is discharged toward a conditioned space as a supply air flow.

Cooling of the air flow via the evaporator may cause moisture suspended within the air flow to condense, thereby forming condensate. In certain instances, condensate generated via the evaporator may initially collect on the heat exchange area of the evaporator. Condensate formed and/or accumulated on the evaporator may fall (e.g., via force of gravity) toward a drain pan positioned vertically beneath the evaporator. The drain pan may collect the condensate that falls from the evaporator and direct the condensate toward a drain or other suitable discharge outlet. Unfortunately, in some applications, the evaporator may be arranged (e.g., positioned, oriented) in a manner that reduces the effectiveness of conventional drain pans.

For example, in some cases an HVAC system or HVAC unit having an evaporator may be arranged to direct an air flow across the evaporator in a generally lateral direction, such as either left to right or right to left. An air flow directed across the evaporator may cause condensate formed and/or accumulated thereon to become dislodged from the evaporator. More specifically, the air flow may dislodge the condensate from the evaporator and displace or carry the condensate in a direction (e.g., lateral direction) of the air flow. Moreover, increased turbulence and/or velocity of the air flow may cause the dislodged condensate to travel away from the evaporator (e.g., in a direction of the air flow). Condensate carried by the air flow may not fall, via force of gravity, into the drain pan positioned beneath the evaporator, which may result in the condensate permeating areas or regions external to the drain pan and/or HVAC unit. Therefore, it is now recognized that improved condensate collection systems are desirable for HVAC systems.

Accordingly, embodiments of the present disclosure are directed to an improved condensate collection assembly that enables improved capture of condensate formed during operation of an HVAC system. For example, the condensate collection assembly may include one or more components configured to enable capture of condensate that may be susceptible to lateral discharge from an evaporator via an air flow directed across the evaporator in a lateral (e.g., horizontal, sideways) direction. As described in further detail below, the condensate collection assembly may include a drain pan and a condensate capture receptacle (e.g., a condensate shield, a condensate trough, a condensate covering) with one or more condensate ports (e.g., discharge ports, drainage ports). The condensate capture receptacle may be positioned at a downstream end of a heat exchanger (e.g., an evaporator) and may be configured to capture condensate generated during operation of the heat exchanger. To this end, the condensate collection assembly may include one or more support brackets configured to couple the condensate capture receptacle to the heat exchanger. In particular, the one or more support brackets may support and suspend the condensate capture receptacle, such as above the drain pan relative to gravity. In this way, present embodiments enable capture of condensate dislodged from the heat exchanger, while also reducing or limiting air flow obstruction or interference caused by the condensate collection assembly.

The condensate capture receptacle may be positioned on a lateral side (e.g., laterally adjacent to) the heat exchanger, such that the condensate capture receptacle may overlap with (e.g., shield) a lateral end of the heat exchanger relative to a direction of air flow across the heat exchanger. Further, the condensate capture receptacle may be configured to block discharge of condensate in an outward (e.g., laterally outward) direction. In particular, the condensate capture receptacle may block discharge of condensate from a region or area generally defined by a perimeter of the drain pan. Additionally, the condensate capture receptacle may define a cavity configured to capture the discharged condensate blocked by the condensate capture receptacle. Condensate captured within the cavity may be directed toward the one or more condensate ports, and the one or more condensate ports may direct the condensate toward the drain pan for collection and discharge in a suitable manner. In this way, present embodiments enable improved capture and collection of condensate generated during operation of the HVAC system. Additional details and benefits enabled by the present embodiments are described in further detail below.

Turning now to the drawings, FIG. 1 illustrates an embodiment of a heating, ventilation, and/or air conditioning (HVAC) system for environmental management that employs one or more HVAC units in accordance with the present disclosure. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12 with a reheat system in accordance with present embodiments. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
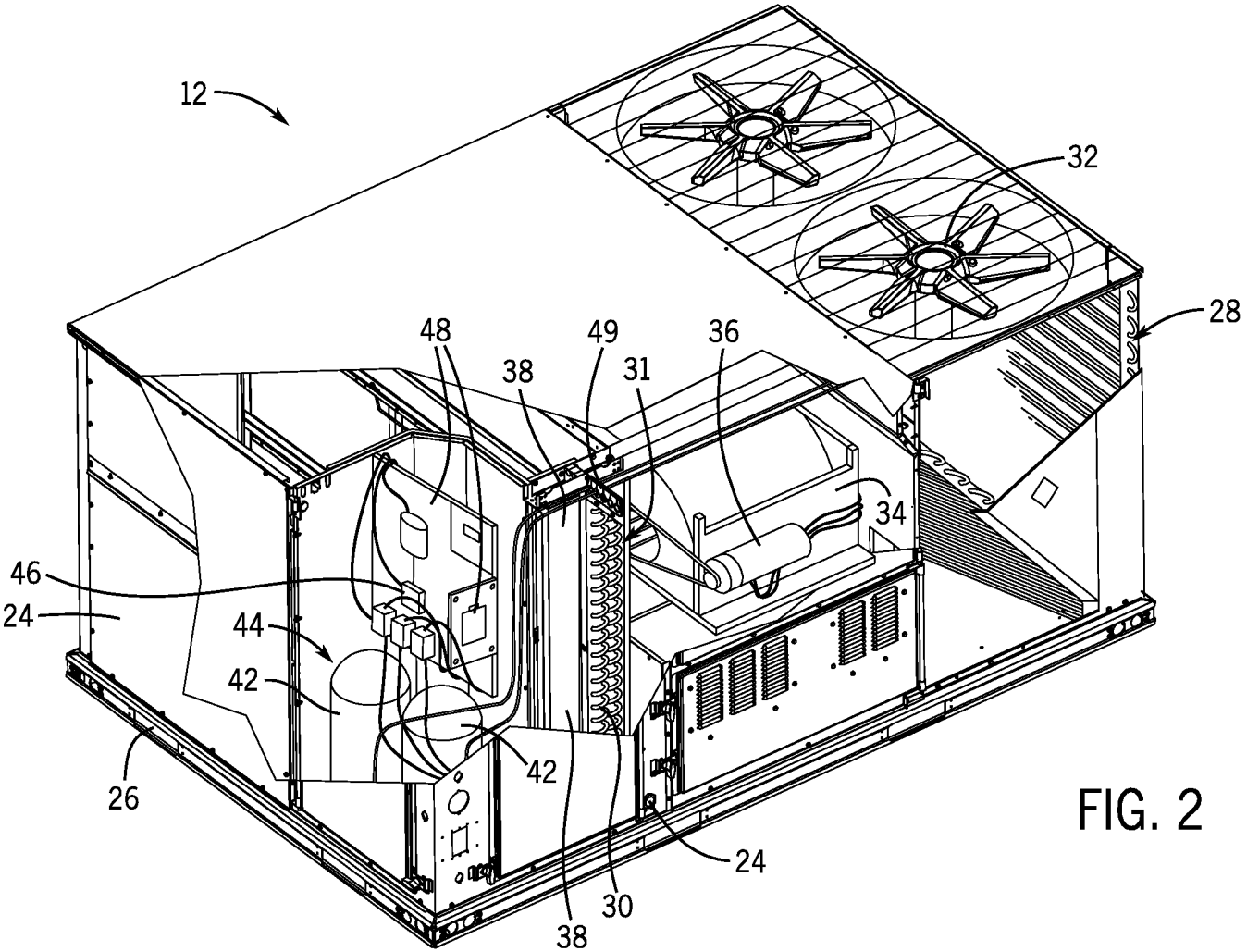
FIG. 2 is a perspective view of an embodiment of a packaged HVAC unit, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multi-channel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
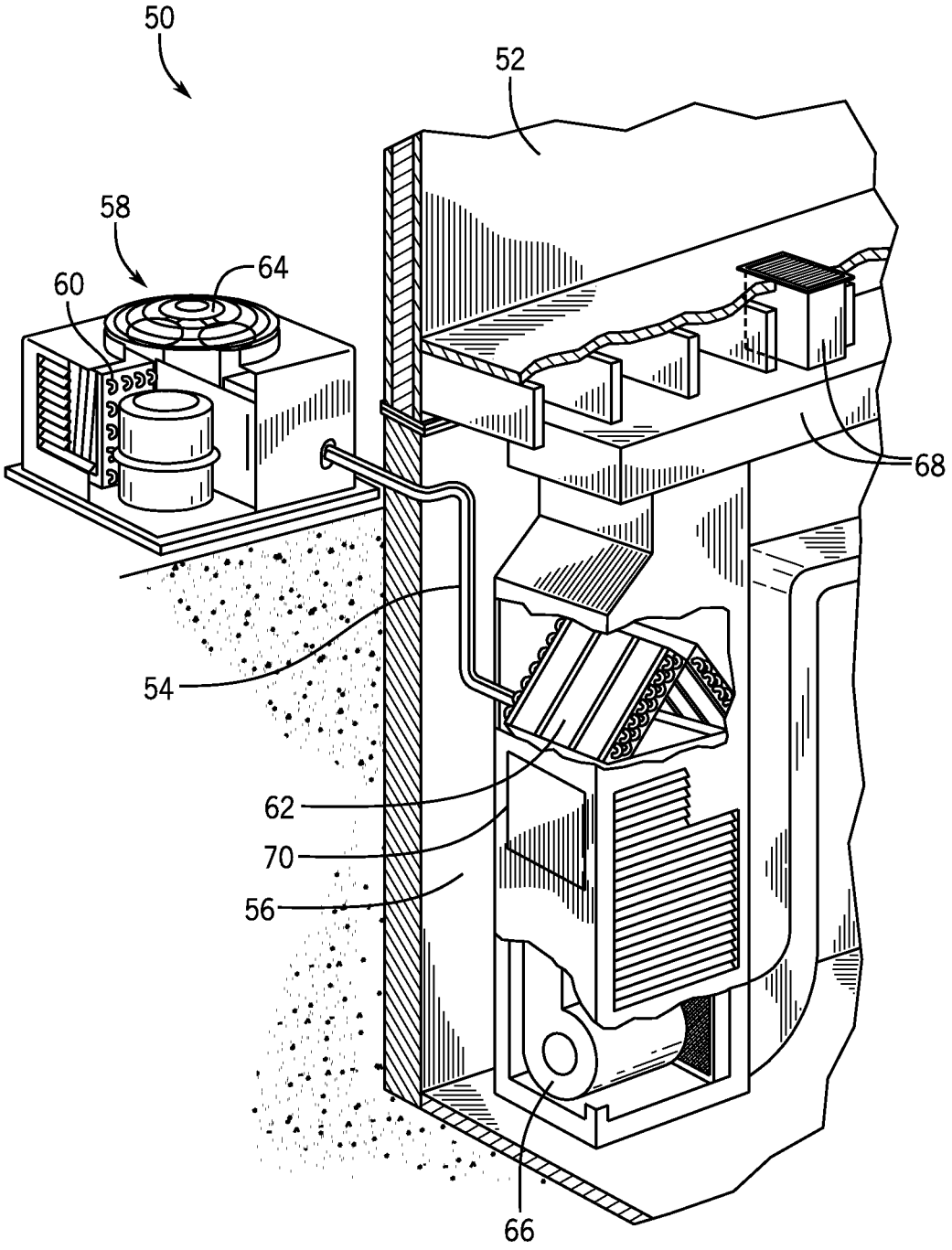
FIG. 3 is a perspective view of an embodiment of a split, residential HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily. The outdoor unit 58 includes a reheat system in accordance with present embodiments.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the outdoor heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
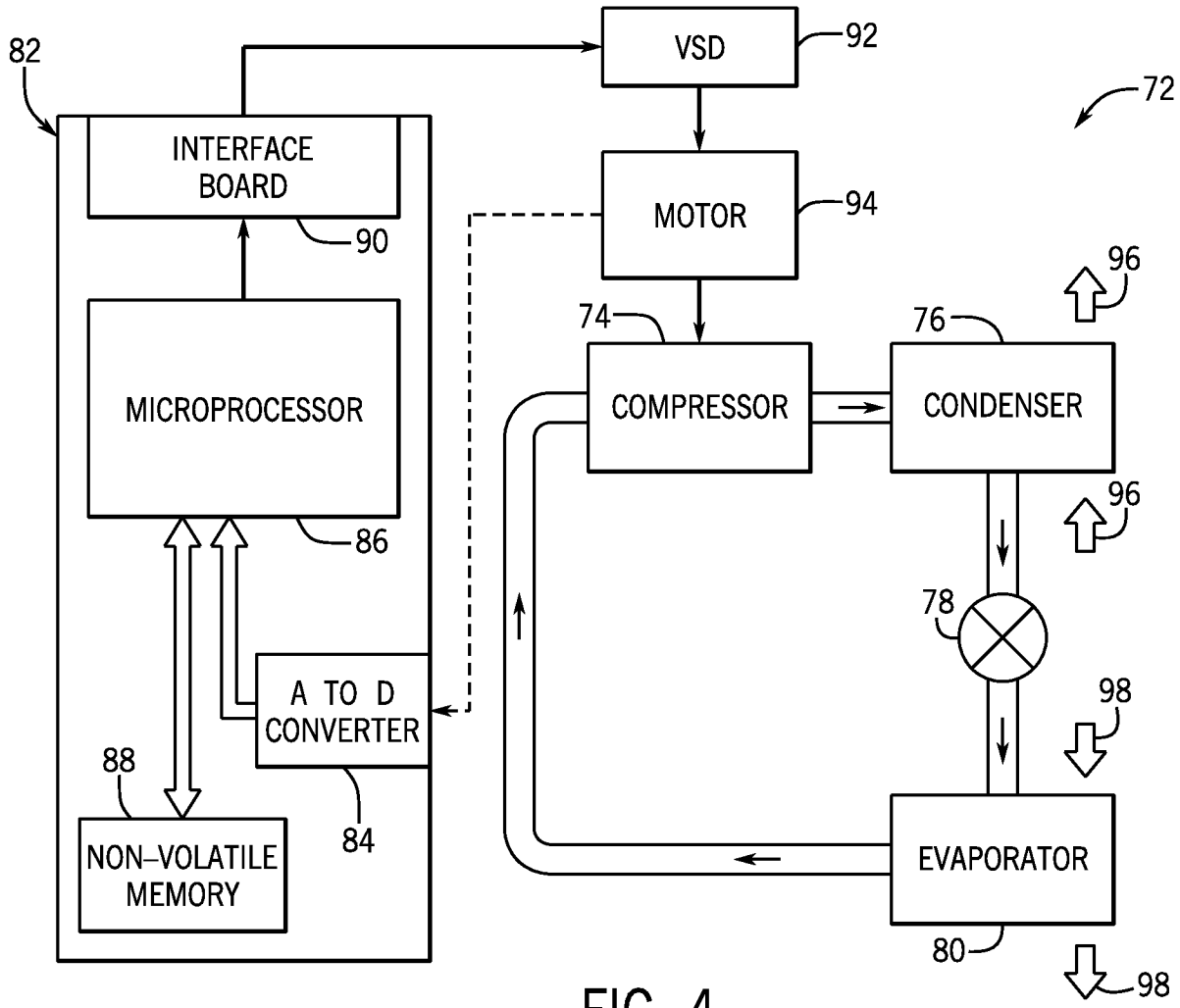
FIG. 4 is a schematic diagram of an embodiment of a vapor compression system used in an HVAC system, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil. In the illustrated embodiment, the reheat coil is represented as part of the evaporator 80. The reheat coil is positioned downstream of the evaporator heat exchanger relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

As noted above, HVAC systems typically include a drain pan configured to collect condensate that may form during operation of the HVAC system. Unfortunately, conventional systems generally rely on the force of gravity to direct condensate from a heat exchanger to the drain pan, which may not adequately facilitate desirable collection of condensate. For example, HVAC systems oriented to direct air flow across a heat exchanger in a lateral direction (e.g., horizontal right configuration, horizontal left configuration) may be susceptible to peripheral or external discharge of condensate. In other words, conventional drain pans may not adequately capture condensate generated during operation of the HVAC system, and condensate may undesirably travel (e.g., via air flow directed across the heat exchanger) to regions or areas external to the drain pan. Accordingly, embodiments of the present disclosure are directed toward a condensate collection assembly that is configured to more efficiently capture condensate generated during HVAC system operation.

Figure 5:
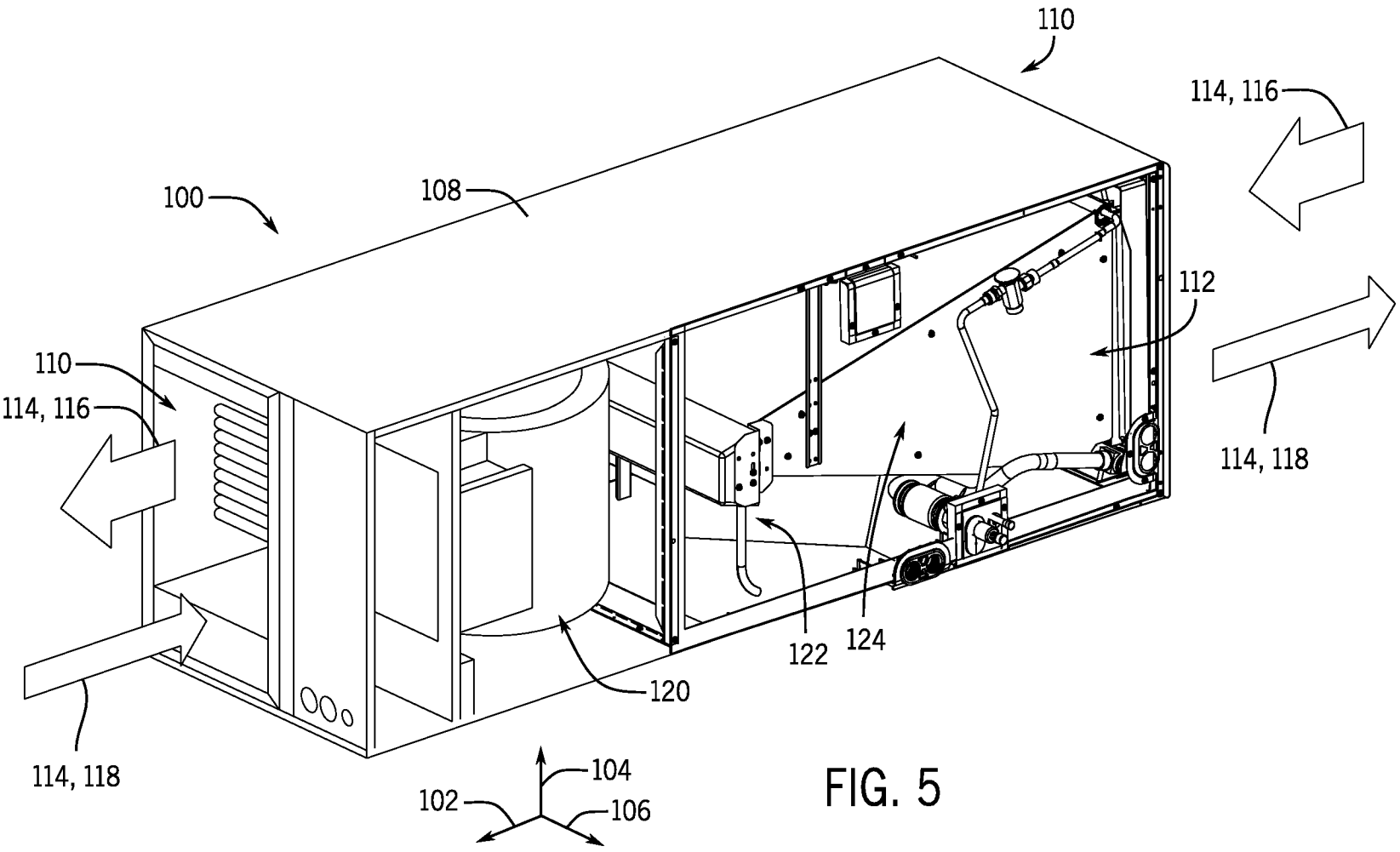
FIG. 5 is a perspective view of an embodiment of an HVAC unit including a condensate collection assembly, in accordance with an aspect of the present disclosure.

With the foregoing in mind, FIG. 5 is a perspective view of an embodiment of an HVAC unit 100 that can be used in any suitable HVAC system, such as the HVAC unit 12 of FIG. 1, the split, residential HVAC system 50 of FIG. 3, and/or the vapor compression system 72 of FIG. 4. Indeed, it should be noted that the HVAC unit 100 may include embodiments and/or components of the HVAC unit 12, embodiments or components of the split, residential HVAC system 50, a rooftop unit (RTU), an air handler or air handling unit, an outdoor unit, and indoor unit, or any other suitable HVAC system. To facilitate discussion, the HVAC unit 100 and its respective components may be described with reference to a longitudinal axis 102, a vertical axis 104, which is oriented relative to a direction of gravity, and a lateral axis 106.

In the illustrated embodiment, the HVAC unit 100 includes a housing 108 defining an air flow path 110 therethrough. A heat exchanger 112 is disposed within the housing 108 and along the air flow path 110. The HVAC unit 100 is configured to direct an air flow 114 through the housing 108 and across the heat exchanger 112 to enable conditioning of the air flow 114. For example, the heat exchanger 112 may be an evaporator or other cooling coil configured to cool the air flow 114 directed through the housing 108. In the illustrated embodiment, the housing 108 and the heat exchanger 112 are arranged in a generally horizontal flow configuration. In other words, the housing 108 is configured to direct the air flow 114 in a generally horizontal direction (e.g., along the longitudinal axis 102) along the air flow path 110 and across the heat exchanger 112. In some embodiments, the air flow 114 may be directed in through the housing 108 and across the heat exchanger 112 in a first direction 116 (e.g., in a horizontal left configuration of the heat exchanger 112) or in a second direction 118 (e.g., in a horizontal right configuration of the heat exchanger 112). In the illustrated embodiment, the HVAC unit 100 includes a blower 120 configured to draw the air flow 114 into the housing 108 and across the heat exchanger 112 and to discharge the air flow 114 from the housing 108. The air flow 114 may enter the housing 108 as a pre-conditioned air flow, a return air flow, an ambient air flow, any combination thereof, or another suitable air flow. The air flow 114 discharged from the HVAC unit 100 may be directed toward a conditioned space, such as via ductwork fluidly coupled to the air flow path 110.

As mentioned above, the heat exchanger 112 is configured to condition the air flow 114 directed through the housing 108 and across the heat exchanger 112. For example, the heat exchanger 112 may be an evaporator configured to cool the air flow 114. In some instances, the housing 108 may also include an additional heat exchanger disposed within the air flow path 110, such as a heating coil. In certain operating modes of the HVAC unit 100, the heat exchanger 112 (e.g., evaporator, cooling coil) and additional heat exchanger (e.g., heating coil) may operate in conjunction with one another to dehumidify the air flow 114. During cooling and/or dehumidification of the air flow 114, moisture within the air flow 114 may condense to form condensate in the form of liquid droplets. For example, condensate may form and/or collect on the heat exchanger 112.

As will be appreciated, it is desirable to collect and discharge condensate generated during operation of the HVAC unit 100 in a suitable manner. For example, it is desirable to capture the condensate and drain the condensate along a suitable flow path, as well as mitigate transfer of condensate to unintended areas or region (e.g., within the housing 108, external to the housing 108). Accordingly, the HVAC unit 100 includes a condensate collection assembly 122 configured to capture and collect condensate generated from the air flow 114 during operation of the HVAC unit 100. For example, the condensate collection assembly 122 is configured to capture and collect condensate that may form on the heat exchanger 112 and may fall from the heat exchanger 112 (e.g., along vertical axis 104) due to force of gravity. The condensate collection assembly 122 is also configured to capture condensate that may be dislodged from the heat exchanger 112 (e.g., at least partially along longitudinal axis 102) via the air flow 114 directed across the heat exchanger 112. As described herein, condensate dislodged from the heat exchanger 112 by the air flow 114 and traveling at least partially in a direction of the air flow 114 may be referred to as "condensate blowoff" or "condensate carryover." The condensate collection assembly 122 of the present disclosure is configured to capture condensate blowoff or carryover and block condensate exposure to unintended areas, such as certain areas within the housing 108, the blower 120, filters (e.g., filter 38) within the housing 108, ductwork (e.g., ductwork 14 and 68) fluidly coupled to the housing 108, and/or other unintended areas associated with the HVAC unit 100 (e.g., building 10, residence 52).

In the illustrated embodiment, the condensate collection assembly 122 includes components disposed beneath (e.g., relative to vertical axis 104) the heat exchanger 112. The condensate collection assembly 122 also includes components disposed on or adjacent one or more lateral sides 124 (e.g., vertically-extending sides) of the heat exchanger 112. In other words, the condensate collection assembly 122 includes components disposed laterally outward (e.g., relative to longitudinal axis 102 and/or lateral axis 106) from the heat exchanger 112. In the manner described below, the components of the condensate collection assembly 122 enable capture and collection of condensate that may fall from the heat exchanger 112 (e.g., along vertical axis 104), as well as condensate that may be dislodged by the air flow 114 directed across the heat exchanger 112. The condensate captured and collected by the condensate collection assembly 122 may then be discharged or drained from the HVAC unit 100 in a desirable manner.

The embodiments discussed below with reference to FIGS. 6-10 are described in the context of the HVAC unit 100 arranged to direct the air flow 114 through the housing 108 of the HVAC unit 100 in the first direction 116. In other words, the HVAC unit 100 and condensate collection assembly 122 described as implemented with the HVAC unit 100 in a horizontal left configuration. However, it should be appreciated that embodiments of the condensate collection assembly 122 may be similarly implemented with the HVAC unit 100 oriented in a horizontal right configuration and with the air flow 114 directed through the housing 108 in the second direction 118 discussed above. Additionally, in some embodiments the condensate collection assembly 122 may be implemented with the HVAC unit 100 oriented in a vertical flow configuration (e.g., up flow configuration, down flow configuration), in which the HVAC unit 100 is oriented to direct the air flow 114 across the heat exchanger 112 generally along the vertical axis 104.

Figure 6:
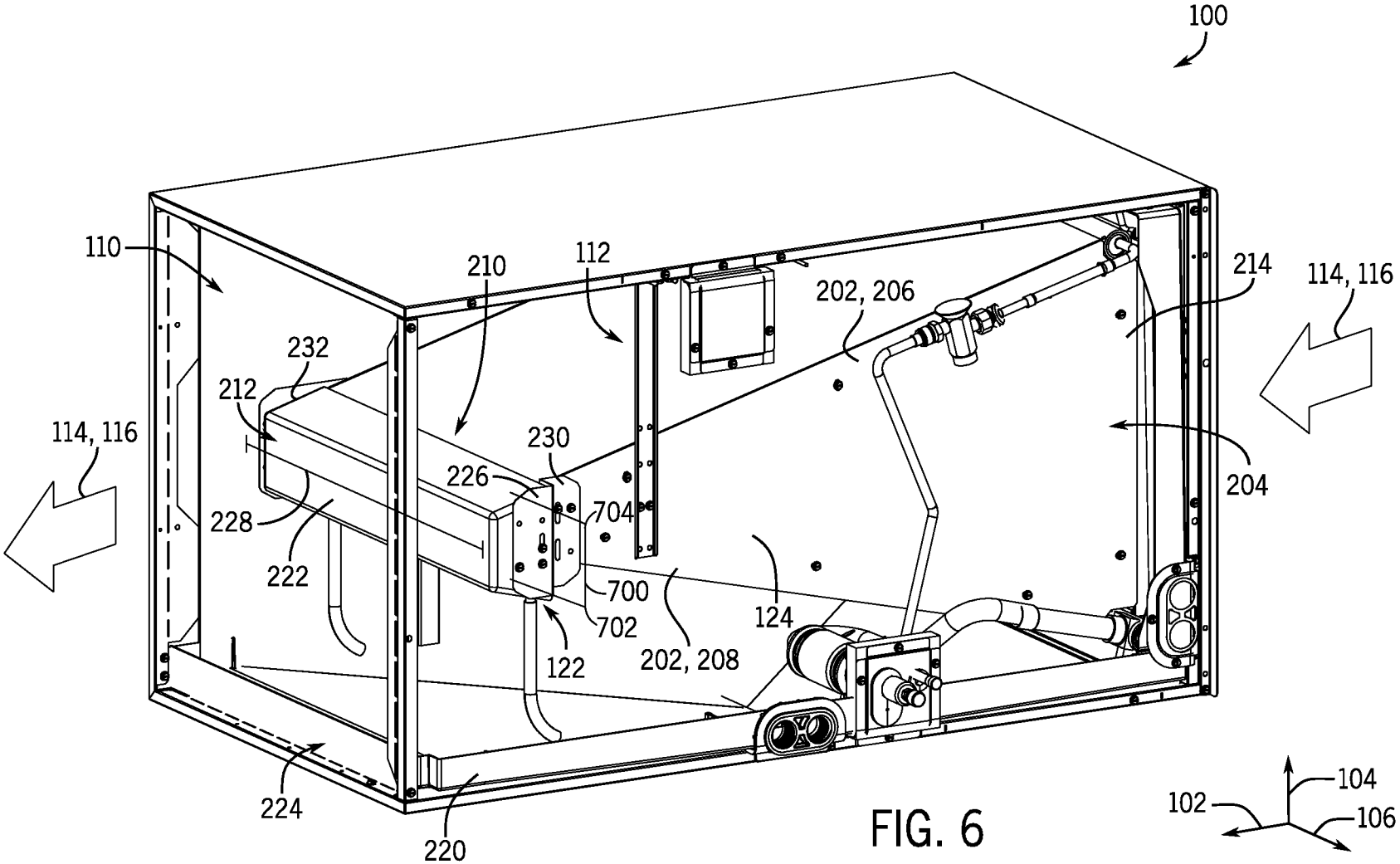
FIG. 6 is a partial perspective view of an embodiment of an HVAC unit including a condensate collection assembly, in accordance with an aspect of the present disclosure.

FIG. 6 is a perspective view of an embodiment of a portion of the HVAC unit 100. For clarity and to better illustrate the condensate collection assembly 122, the blower 120 and certain portions of the housing 108 are not shown. In some embodiments, the heat exchanger 112 disposed within the HVAC unit 100 may include one or more heat exchange slabs 202 (e.g., portions, segments, sections) disposed along the air flow path 110. For example, the heat exchange slabs 202 may include tube and fin heat exchange coils, microchannel heat exchange tubes (e.g., finned microchannel heat exchange tubes), or another suitable type of heat exchanger. The heat exchanger 112 also includes one or more delta plates 204 coupled to the heat exchange slabs 202. The one or more delta plates 204 may function to support the one or more heat exchange slabs 202 in a desired configuration (e.g., relative to one another). In the illustrated embodiment, the heat exchanger 112 includes two heat exchange slabs 202 arranged in an "A" coil configuration. However, in other embodiments, heat exchange slabs 202 may be arranged in a "V", "N", or "Z" configuration. In some embodiments, the heat exchanger 112 may include one heat exchange slab 202 disposed along the air flow path 110 and extending across the air flow path 110. Indeed, the heat exchange slabs 202 may be oriented in any suitable configuration along the air flow path 110 relative to the lateral axis 106, longitudinal axis 102, and/or vertical axis 104.

In the illustrated A-coil configuration, the heat exchange slabs 202 (e.g., a first heat exchange portion 206 of the heat exchanger 112, a second heat exchange portion 208 of the heat exchanger 112) are disposed at an angle relative to one another and relative to the first direction 116 of the air flow 114 through the housing 108. The first heat exchange portion 206 extends along the longitudinal axis 102 in the first direction 116 at a downward slope or angle relative to the vertical axis 104, and the second heat exchange portion 208 extends along the longitudinal axis 102 in the first direction 116 at an upward slope or angle relative to the vertical axis 104. Thus, the heat exchange slabs 202 converge towards one another in the first direction 116 along the longitudinal axis 102, such that respective downstream ends 210 (e.g., relative to the first direction 116 of air flow 114) of the first heat exchange portion 206 and the second heat exchange portion 208 define an apex 212 (e.g., a vertex of the A-coil configuration) of the heat exchanger 112. During operation of the HVAC unit 100, the air flow 114 may initially flow along the air flow path 110 between (e.g., relative to vertical axis 104) respective upstream ends 214 (e.g., relative to the first direction 116 of air flow 114) of the first heat exchange portion 206 and the second heat exchange portion 208. As the air flow 114 travels along the air flow path 110, the air flow 114 may pass across the heat exchange slabs 202. Thereafter, the air flow 114 may continue traveling along the air flow path 110 through the housing 108 (e.g., toward the blower 120).

As mentioned above, each heat exchange slab 202 may include rows of tubes configured to direct refrigerant or working fluid therethrough. Each heat exchange slab 202 may also include fins coupled to and extending between the respective tubes. The fins may support or reinforce the arrangement of tubes and may also be configured to increase a heat transfer surface area of the heat exchange slabs 202. During operation of the HVAC unit 100 to cool the air flow 114 via the heat exchanger 112, heat may be transferred from the air flow 114 to the refrigerant circulated through the tubes of the heat exchange slabs 202. As a result, moisture within the air flow 114 may condense to form condensate (e.g., water droplets) that may collect on heat exchange slabs 202 (e.g., tubes, fins, and/or the delta plates 204). In some instances, the velocity and/or turbulence of the air flow 114 may cause condensate formed on one or more of the heat exchange slabs 202 to travel at least partially in the first direction 116. That is, the air flow 114 may drive or force condensate formed on the heat exchange slabs 202 to become dislodged from the heat exchange slabs 202 and migrate in the first direction 116 (e.g., along the fins and/or tubes, toward the apex 212 of the heat exchanger 112).

To capture and collect condensate generated via operation of the heat exchanger 112, the HVAC unit 100 includes the condensate collection assembly 122. As shown, the condensate collection assembly 122 may be configured to couple to one or more of the heat exchange slabs 202, one or more of the delta plates 204, or both. In the illustrated embodiment, the condensate collection assembly 122 includes a drain pan 220 disposed within the housing 108 and beneath the heat exchanger 112 relative to the vertical axis 104. The condensate collection assembly 122 also includes a condensate capture receptacle 222 disposed within the housing 108 and adjacent one or more lateral sides 124 of the heat exchanger 112. Additionally, the condensate collection assembly 122 may include one or more support brackets 226 configured to couple the condensate capture receptacle 222 to one or more of the heat exchange slabs 202, one or more of the delta plates 204, or both. That is, the support brackets 226 may support and suspend the condensate capture receptacle 222 from the drain pan 220. In this way, the condensate capture receptacle 222 may be suspended above the drain pan 220 relative to the vertical axis 104, and the condensate capture receptacle 222 may be disposed within the air flow path 110.

As illustrated in FIG. 6, the condensate capture receptacle 222 may extend from a first support bracket 230 to a second support bracket 232 and across the air flow path 110 extending through the housing 108. Furthermore, the condensate capture receptacle 222 may be disposed at least partially laterally outward from the heat exchanger 112 (e.g., along longitudinal axis 102 and/or lateral axis 106). In addition, the condensate capture receptacle 222 may be at least partially disposed within (e.g., across) the air flow path 110 defined by the housing 108. The condensate capture receptacle 222 is coupled to the heat exchanger 112 (e.g., via the support brackets 226) and is disposed within an outer perimeter 224 defined by the drain pan 220. Accordingly, the condensate capture receptacle 222 may be configured to direct captured condensate into the drain pan 220. Details of the condensate collection assembly 122 are described further below with respect to FIG. 8.

In addition to efficiently capturing condensate generated during operation of the HVAC unit 100, the condensate capture receptacle 222 may also improve overall heat exchange efficiency of the HVAC unit 100 by blocking portions of the air flow 114 from exiting the heat exchanger 112 through the apex 212 of the heat exchanger 112 and diverting (e.g., redirecting) the portions of the air flow 114, such that the portions of the air flow 114 flow across other portions of the first and/or second heat exchange slabs 202 instead of through the apex 212 of the heat exchanger 112. In particular, as described above, each of the heat exchange slabs 202 may include heat exchange tubes configured to direct refrigerant therethrough, and the heat exchange slabs 202 may include fins extending between the heat exchange tubes. The fins extending from and between the heat exchange tubes may be configured to increase a heat transfer surface area of the heat exchange slabs 202, and thus increase the amount of total heat transfer of the heat exchanger 112.

However, the apex 212 of the heat exchanger 112, or any point at which two or more heat exchange slabs 202 converge (e.g., such as convergent points of the V", "N", or "Z" configurations), may include a gap without heat exchange tubes between respective converging heat exchange slabs 202. For example, two separate heat exchange slabs 202 may converge at the apex 212 and may define a gap or space of the heat exchanger 112 at the apex 212. Alternatively, some embodiments of the heat exchanger 112 may include a section of heat exchange tubes that do not include fins. For example, the heat exchanger 112 may include microchannel tubes that form multiple heat exchange slabs 202. That is, microchannel tubes may extend along both the first heat exchange portion 206 and the second heat exchange portion 208 to define multiple heat exchange slabs 202 that are fluidly coupled to one another at the apex 212. To this end, the microchannel tubes extending from the first heat exchange portion 206 to the second heat exchange portion 208 may be bent or curved at the apex 212. In such an embodiment, the heat exchanger 112 may not include fins extending between the heat exchange tubes (e.g., microchannel tubes) at the apex 212 to facilitate bending of the heat exchange tubes extending from one heat exchange slab 202 to another heat exchange slab 202. As a result, portions of the air flow 114 that travel through the apex 212 of the heat exchanger 112 may experience less efficient heat transfer as compared to portions of the air flow 114 that flow across the heat exchange slabs 202 at locations having heat exchange tubes with fins. As illustrated in FIG. 6, the condensate capture receptacle 222 may be positioned (e.g., installed, mounted, coupled, directly coupled) to the heat exchanger 112 such that the condensate capture receptacle 222 covers (e.g., encases, shields, overlaps) the apex 212 of the heat exchanger 112 (e.g., relative to the air flow 114 directed in the first direction 116). In particular, the condensate capture receptacle 222 may block the air flow 114 from crossing the heat exchanger 112 at the apex 212, which may be a region of the heat exchanger 112 without heat exchange tubes (e.g., a gap between the converging heat exchange slabs 202) or may be a region of the heat exchanger 112 with heat exchange tubes (e.g., microchannel tubes) that do not include fins.

By covering or overlapping with the apex 212 of the heat exchanger 112, the condensate capture receptacle 222 may block portions of the air flow 114 from exiting the heat exchanger 112 through the apex 212 and may instead divert (e.g., redirect) those portions of the air flow 114 to exit the heat exchanger 112 by flowing across the first and/or second heat exchange slabs 202 instead of through the apex 212. Therefore, including the condensate capture receptacle 222 to the heat exchanger 112 may increase the overall heat transfer efficiency of the heat exchanger 112 by causing a greater percentage of the air flow 114 to travel across (e.g., interact with) portions of heat exchange tubes having fins as compared to an HVAC unit operating without the condensate capture receptacle 222. Thus, the condensate capture receptacle 222 may improve the performance of the heat exchanger 112 during operation in addition to efficiently and effectively capturing condensate generated by the heat exchanger 112.

Figure 7:
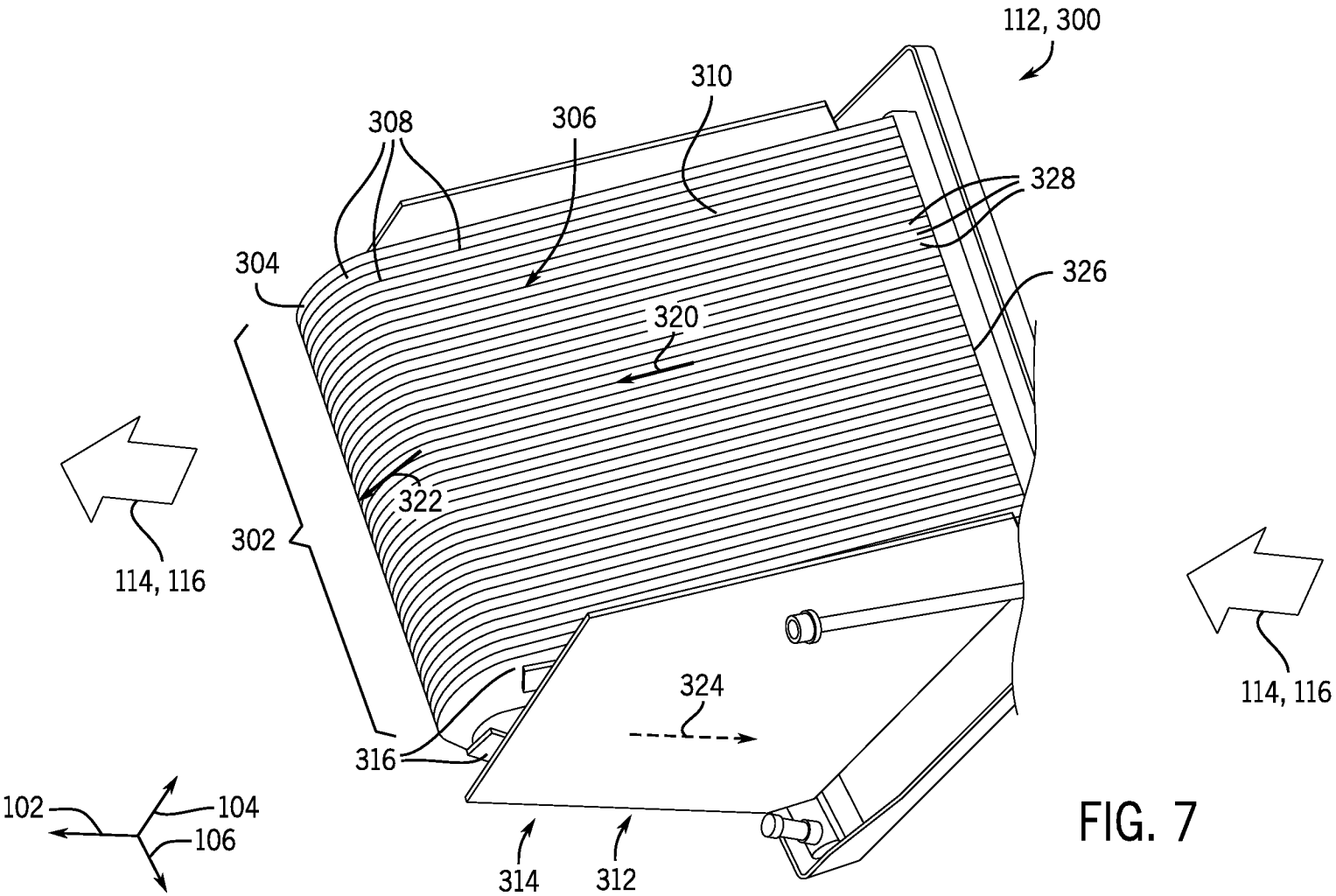
FIG. 7 is a perspective view of an embodiment of a heat exchanger that may be disposed within the housing of an HVAC unit, in accordance with an aspect of the present disclosure.

FIG. 7 is a perspective view of an embodiment of the heat exchanger 112 that may be disposed within the housing 108 of the HVAC unit 100. As noted above, FIG. 7 is described below in the context of the HVAC unit 100 arranged to direct the air flow 114 through the housing 108 of the HVAC unit 100 in the first direction 116. The heat exchanger 112 of the illustrated embodiment is a microchannel heat exchanger 300 having a plurality of microchannel tubes 308 defining an "A" configuration, as similarly described above. That is, the microchannel heat exchanger 300 includes a first section 306 (e.g., first heat exchange slab 202) and a second section 312 (e.g., second heat exchange slab 202) arranged to define the "A" configuration. Each microchannel tube 308 of the plurality of microchannel tubes 308 is included in both the first section 306 and the second section 312. For example, each microchannel tube 308 may include a first portion 310 included in the first section 306 of the microchannel heat exchanger 300 and a section portion 314 included in the second section 312 of the microchannel heat exchanger 300. The first portion 310 and the second portion 314 of each microchannel tube 308 may be fluidly coupled to one another via a bent portion 302 of the respective microchannel tube 308. Thus, the first portion 310 and the second portion 314 of the microchannel heat exchanger 300 are fluidly coupled to one another.

The bent portions 302 of the plurality of microchannel tubes 308 may define an apex 304 of the microchannel heat exchanger 300. To facilitate manufacturing of the microchannel heat exchanger 300, the bent portions 302 of the microchannel tubes 308 may not include fins extending therebetween. Specifically, the microchannel tubes 308 may be bent at the bent portions 302 and may be angled, twisted, or otherwise manipulated to enable desired packaging or arrangement of the microchannel tubes 308 relative to one another in the "A" configuration without compromising (e.g., blocking, restricting) internal flow paths (e.g., microchannels) of the microchannel tubes 308. As a result, the microchannel tubes 308 may not include fins extending therebetween at the bent portions 302 (e.g., the apex 304). However, the first section 306 of the microchannel heat exchanger 300 may include fins extending between the first portions 310 of the microchannel tubes 308, and the second section 312 of the microchannel heat exchanger 300 may include fins extending between the second portions 314 of the microchannel tubes 308.

As similarly discussed above, the first and second sections 306, 312 of the microchannel heat exchanger 300 may be disposed at an angle relative to one another and relative to the first direction 116 of the air flow 114 directed through the housing 108 and across the microchannel heat exchanger 300. The first portions 310 of the microchannel tubes 308 in the first section 306 may extend along the longitudinal axis 102 at a downward slope or angle relative to the vertical axis 104, and the second portions 314 of the microchannel tubes 308 in the second section 312 may extend along the longitudinal axis 102 at an upward slope or angle relative to the vertical axis 104. Thus, the first and second sections 306, 312 of the microchannel heat exchanger 300 converge towards one another in the first direction 116 along the longitudinal axis 102, such that respective downstream ends 316 (e.g., relative to the first direction 116 of air flow 114) of the first and second sections 306, 312 of the microchannel heat exchanger 300 may partially define the apex 304 (e.g., a vertex of the "A" configuration) of the microchannel heat exchanger 300.

As mentioned above, each microchannel tube 308 may include a plurality of channels or flow paths (e.g., internal flow paths, microchannels) formed therethrough to direct a flow of refrigerant through the microchannel tubes 308 (e.g., through the first portion 310, the bent portion 302, and the second portion 314). During operation, the refrigerant may flow into the first portions 310 of the microchannel tubes 308, and may be directed generally in a first direction of flow 320 through the first section 306 of the microchannel heat exchanger 300 toward the apex 304 of the microchannel heat exchanger 300. The refrigerant may then flow generally in a second direction of flow 322 through the bent segments 302 of the microchannel tubes 308 that curves around the apex 304 of the microchannel heat exchanger 300. Thereafter, the refrigerant may flow into the second portions 314 of the microchannel tubes 308, and may be directed generally in a third direction of flow 324 through the second section 312 of the microchannel heat exchanger 300. Thereafter, the refrigerant may be discharged from the microchannel heat exchanger 300. It should be appreciated that, in some embodiments, the refrigerant may be directed to flow through the microchannel tubes 308 in an direction opposite that described above. For example, the refrigerant may flow into the second portions 314 of the microchannel tubes 308, flow along the second section 312 toward the bent portions 302 the microchannel tubes 308, flow around the apex 304 of the microchannel heat exchanger 300, and then flow through the first portions 310 of the microchannel tubes 308 and along the first section 306 before discharged from the microchannel heat exchanger 300.

In the illustrated embodiment, each microchannel tube 308 may have a generally ribbon shape (e.g., a width of the microchannel tube 308 is greater than a thickness or height of the microchannel tube 308), and each microchannel tube 308 may be positioned within the first and second sections 306, 312 of the microchannel heat exchanger 300 such that a width of each microchannel tube 308 extends along the vertical axis 104. Additionally, each microchannel tube 308 may extend continuously from an upstream end 326 of the first section 306 of the microchannel heat exchanger 300, around the apex 304, and to an upstream end 326 of the second section 312 of the microchannel heat exchanger 300. To this end, a portion of each microchannel tube 308 at the bent portion 302 that is bent around the apex 304 may be additionally rotated (e.g., twisted) so as to prevent crimping (e.g., closing) one or more of the fluid channels within the bent portions 302 of the microchannel tubes 308 at the apex 304. Furthermore, as mentioned above, each the first and second sections 306, 312 of the microchannel heat exchanger 300 may include a respective sets of fins 328 extending from and between the microchannel tubes 308 to increase heat transfer efficiency of the microchannel heat exchanger 300. The fins 328, 330 may additionally support and/or provide structural reinforcement to the microchannel tubes 308. However, the bent portions 302 of the microchannel tubes 308 may be fin-less or bare so as to facilitate the rotation and bending of the bent portions 302 of the microchannel tubes 308 around the apex 304 of the microchannel heat exchanger 300.

Furthermore, during operation of the HVAC unit 100, and with additional reference to FIG. 6, the air flow 114 may initially flow along the air flow path 110 between (e.g., relative to vertical axis 104) the respective upstream ends 326 (e.g., relative to the first direction 116 of air flow 114) of the first and second sections 306, 312 of the microchannel heat exchanger 300. As the air flow 114 travels along the air flow path 110, the air flow 114 may pass across the first and second portions 310, 314 of the microchannel tubes 308. However a portion of the air flow 114 may pass across the apex 304 and thus across the bent portions 302 (e.g., fin-less portions) of the microchannel tubes 308 that curve around the apex 304. As discussed above, fin-less portions of heat exchange tubes (e.g., the bent portions 302 of the microchannel tubes 308) of the heat exchanger 112 may provide relatively less heat transfer compared to finned portions of heat exchange tubes (e.g., the first and second portions 310, 314 of the microchannel tubes 308) of the heat exchanger 112. Therefore, including the condensate capture receptacle 222 with the microchannel heat exchanger 300 of FIG. 7 may increase the overall heat transfer efficiency of the microchannel heat exchanger 300 by causing a greater percentage of the air flow 114 to travel across (e.g., interact with) the first and second portions 310, 314 of the microchannel tubes 308 having fins. Thus, the condensate capture receptacle 222 may improve the performance of the microchannel heat exchanger 300 during operation in addition to efficiently and effectively capturing condensate generated by the microchannel heat exchanger 300, as discussed herein.

Due to the additional benefits of improved (e.g., increased) overall heat transfer of the heat exchanger 112 (e.g., microchannel heat exchanger 300), it should be appreciated that, in some embodiments, the condensate collection assembly 122 (e.g., the condensate capture receptacle 222) may be included in HVAC units 100 oriented in any suitable direction. For example, in some embodiments, the heat exchanger 112 (e.g., microchannel heat exchanger 300) may be oriented in a vertical configuration, in which the heat exchanger 112 may be positioned such that the apex 212 (e.g., apex 304) of the heat exchanger 112 is facing up and is positioned at a top of the heat exchanger 112 with respect to the vertical axis 104. Alternatively, in other embodiments, the apex 212 of the heat exchanger 112 may be facing down and is positioned at a bottom of the heat exchanger 112 with respect to the vertical axis 104. It should be appreciated that the condensate collection assembly 122 (e.g., the condensate capture receptacle 222) may increase overall heat transfer, and thus improve the performance of the heat exchanger 112 oriented in any direction.

Figure 8:
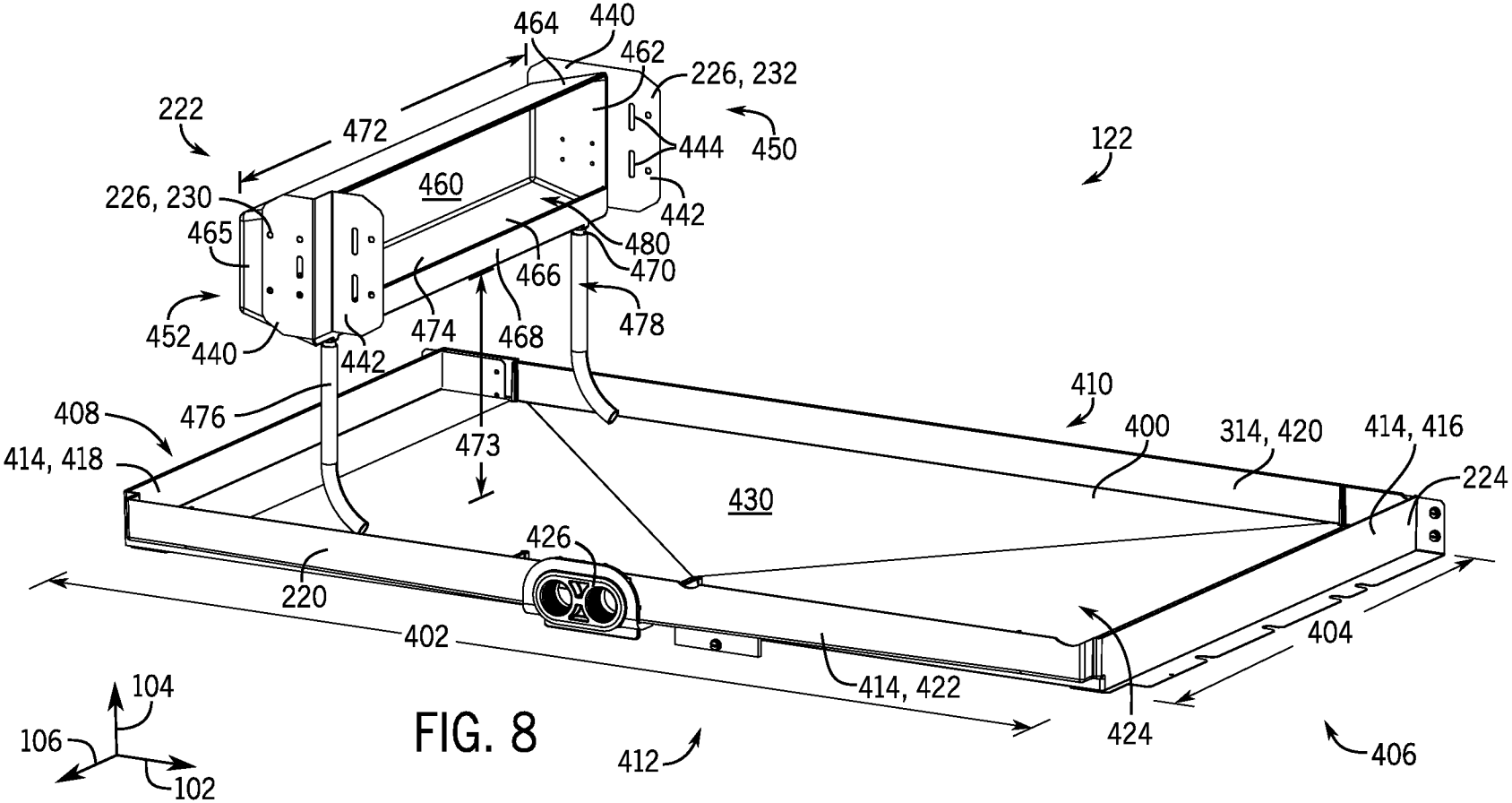
FIG. 8 is a perspective view of an embodiment of a condensate collection assembly, in accordance with an aspect of the present disclosure.

FIG. 8 is a perspective view of an embodiment of the condensate collection assembly 122, which may be disposed within the HVAC unit 100 or any other suitable HVAC system having the heat exchanger 112 that may generate condensate. As mentioned above, the condensate collection assembly 122 may include the drain pan 220, the condensate capture receptacle 222, and the support brackets 226. In the illustrated embodiment, the drain pan 220 includes a body portion 400 (e.g., a base, base surface, condensate collection surface) defining and extending along a length 402 of the drain pan 220 from a first end portion 406 (e.g., longitudinal end, longitudinal side) to a second end portion 408 (e.g., longitudinal end, longitudinal side) of the drain pan 220. For clarity, it should be noted that the length 402 may extend generally along to the longitudinal axis 102. The body portion 400 also defines and extends along a width 404 of the drain pan 220 from a third end portion 410 (e.g., lateral end, lateral side) to a fourth end portion 412 (e.g., lateral end, lateral side), and the width 404 may extend generally along to the lateral axis 106.

The drain pan 220 also includes a plurality of walls 414 (e.g., side walls) extending from the body portion 400. In particular, the drain pan 220 includes a first wall 416 extending from the body portion 400 at the first end portion 406, a second wall 418 extending from the body portion 400 at the second end portion 408, a third wall 420 extending from the body portion 400 at the third end portion 410, and a fourth wall 422 extending from the body portion 400 at the fourth end portion 412. The first, second, third, and fourth walls 416, 418, 420, and 422 may generally define the outer perimeter 224 of the drain pan 220. The body portion 400 and the plurality of walls 414 cooperatively define a basin 424 (e.g., reservoir, cavity, container, receptacle) of the drain pan 220 that is configured to capture and collect condensate generated during operation of the heat exchanger 112. For example, condensate may fall from the heat exchanger 112 (e.g., along vertical axis 104, via gravity) into the basin 424. Additionally, in the manner described in further detail below, the condensate capture receptacle 222 may capture condensate (e.g., dislodged from the heat exchanger 112 via the air flow 114) and direct the condensate into the basin 424.

The body portion 400 of the drain pan 220 defines or includes a draining surface 430. The first, second, third, and fourth walls 416, 418, 420, and 422 extend from the draining surface 430 and are configured to retain condensate directed into the basin 424. The drain pan 220 further includes a drain port 426 (e.g., condensate port, discharge port) configured to enable discharge of condensate collected within the basin 424. For example, the drain port 426 may be fluidly coupled to a discharge conduit configured to direct condensate toward a location external to the HVAC unit 100. In the illustrated embodiment, the drain port 426 is formed in and/or coupled to the fourth wall 420 of the drain pan 220, but in other embodiments the drain port 426 may be disposed in another suitable location of the drain pan 220.

In some embodiments, the draining surface 430 of drain pan 220 may include or define a slope (e.g., a compound slope) that enables drainage of condensate collected with the basin 424. In other words, one or more portions of the draining surface 430 may be disposed at an angle relative to horizontal (e.g., sloped downwardly relative to gravity) to promote flow of condensate along the draining surface 430 generally towards the drain port 426. In this way, condensate collected within the drain pan 220 may be suitably discharged from the HVAC unit 100. For example, the draining surface 430 may be sloped downwardly (e.g., with respect to gravity, relative to vertical axis 104) toward the drain port 426, such that force of gravity may direct condensate accumulated on the draining surface 430 toward the drain port 426. In some embodiments, one or more portions of the draining surface 430 may include a compound slope angled downwardly along the length 402 of the drain pan 220. In some embodiments, the draining surface 430 may be sloped (e.g., downwardly sloped relative to gravity and/or vertical axis 104) along the width 404 of the drain pan 220, such as from the third wall 420 to the fourth wall 422 (e.g., along lateral axis 106). Accordingly, the compound slope of the draining surface 430 may enable condensate collected on the draining surface 430 to flow generally along a direction of decline of the draining surface 430 toward the drain port 426. In such embodiments, the drain port 426 may be located at a lower-most portion (e.g., relative to gravity and/or vertical axis 104) of the draining surface 430. In this manner, the drain pan 220 may be configured to promote drainage and/or discharge of condensate from the basin 424 via the drain port 426.

As illustrated in FIG. 8, the condensate collection assembly 122 also includes the condensate capture receptacle 222. In some embodiments, the condensate capture receptacle 222 may be positioned adjacent one or more lateral sides 124 of the heat exchanger 112. For example, the condensate capture receptacle 222 may be positioned at an end of the heat exchanger 112. Referring back to FIG. 6, the condensate capture receptacle 222 is illustrated as disposed at a downstream end of the heat exchanger 112 relative to air flow 114 in the first direction 116 (e.g., a horizontal left configuration of the HVAC unit 100). However, it should be noted that the installed configuration of the condensate collection assembly 122 shown in FIG. 6 may be similarly utilized with embodiments of the HVAC unit 100 oriented in a horizontal right configuration (e.g., to direct the air flow 114 in the second direction 118), a vertical up flow configuration, or a vertical down flow configuration.

Further, the condensate capture receptacle 222 may be configured to couple to the heat exchanger 112 (e.g., with the heat exchanger 112 at least partially supporting a weight of the condensate capture receptacle 222). To this end, the condensate capture receptacle 222 may be configured to couple (e.g., mount) to one or more components of the heat exchanger 112. The condensate capture receptacle 222 is also configured to capture condensate that may be generated via operation of the heat exchanger 112. In particular, the condensate capture receptacle 222 may be configured to capture condensate that forms on heat exchange coils, fins, and/or tubes and is subsequently dislodged from the heat exchanger 112 via the air flow 114 (e.g., traveling in the first direction 116). Condensate captured by the condensate capture receptacle 222 may then be directed (e.g., via features of the condensate capture receptacle 222 and/or via gravity) into the basin 424 of the drain pan 220 positioned beneath the heat exchanger 112.

As illustrated in FIG. 8, the condensate collection assembly 122 also includes the support brackets 226. At discussed above, the support brackets 226 may couple (e.g., directly couple) the condensate capture receptacle 222 to the heat exchanger 112, such as to the downstream end of heat exchanger 112 (e.g., with respect to the first direction 116 of the air flow 114). In particular, a first portion 440 of each support bracket 226 may couple (e.g., directly couple) to the condensate capture receptacle 222, and a second portion 442 of each support bracket 226 may couple (e.g., directly couple) to the heat exchanger 112 or to a component of the heat exchanger 112 (e.g., one or more of the heat exchange slabs 202, one or more of the delta plates 204, or both). The support brackets 226 may enable positioning of the condensate capture receptacle 222 to overlap with the apex 304 of the heat exchanger 112, and thus overlap with (e.g., cover, enclose) the bent portions 302 of heat exchange tubes at the apex 304 relative to the first direction 116. Furthermore, the support brackets 226 may enable adjustable positioning of the condensate capture receptacle 222 relative to the heat exchanger 112. In this way, the support brackets 226 may enable use of the condensate capture receptacle 222 with heat exchangers 112 of varying size and/or capacity. For example, the support brackets 226 (e.g., the first portion 440 and/or the second portion 442) may have one or more elongated slots 444 formed therethrough to enable adjustability in mounting the condensate capture receptacle 222 to the heat exchanger 112. The first and/or second portions 440, 442 of the support bracket 226 may be mounted (e.g., secured, coupled) respectively to the condensate capture receptacle 222 and/or the heat exchanger 112 via one or more fasteners. In addition, it should be understood that the support brackets 226 may be formed from any suitable material so as to enable secure attachment of the condensate capture receptacle 222 to the heat exchanger 112 (e.g., sheet metal, plastic).

Continuing with reference to FIG. 8, it should be understood that the support brackets 226 may be formed in any suitable shape so as to enable the condensate capture receptacle 222 to be mounted (e.g., secured) to the heat exchanger 112. For example, as illustrated in FIG. 8, a first support bracket 230 of the support brackets 226 is illustrated with the first portion 440 extending in a first plane and the second portion 442 extending in a second plane, different than the first plane. The first and second portions 440, 442 are coupled via a third portion that extends between and crosswise to the first and second portions 440, 442. However, a second support bracket 232 of the support brackets 226 is illustrated as including respective first and second portions 440, 442 both extending in a single or common plane.

The configuration of the support brackets 226 illustrated in FIG. 8 enable the condensate capture receptacle 222 to be secured to a microchannel heat exchanger, such as the microchannel heat exchanger 300 illustrated in FIG. 7. Due to the rotating and bending of the microchannel tubes 308 at the apex 304 of the microchannel heat exchanger 300, as discussed above, the bent portions 302 of the microchannel tubes 308 may flare (e.g., extends) outward (e.g., along lateral axis 106) by an additional width on at least one lateral side of the microchannel heat exchanger 300. In other words, the apex 304 of the microchannel heat exchanger 300 (e.g., formed by the bent portions 302 of the microchannel tubes 308) may have a greater width than a width of the microchannel heat exchanger 300 measured across the first and second sections 306, 312 of the microchannel heat exchanger 300. Thus, the shape of the first and second support brackets 230, 232 may enable positioning of the condensate capture receptacle 222 to overlap with an entire width of the apex 304 of the microchannel heat exchanger 300 while also coupling (e.g., directly coupling) the condensate capture receptacle 222 to the lateral downstream ends 316 of the microchannel heat exchanger 300. In other words, a first lateral side 450 of the condensate capture receptacle 222 may be mounted to (e.g., flush with) a lateral side of the heat exchanger 112 (e.g., via the second support bracket 232), while a second lateral side 452 of the condensate capture receptacle 222 may be mounted to (e.g., not flush with) another lateral side of the heat exchanger 112 (e.g., via the first support bracket 230). Details of the condensate capture receptacle 222 are described further below.

Continuing with reference to FIG. 8, the condensate capture receptacle 222 includes a shield panel 460 (e.g., condensate barrier, capture panel, blocking plate, impingement surface, shield surface), a first side panel 462 (e.g., side wall, at the first lateral side 450), a second side panel 465 (e.g., side wall, on the second lateral side 452), a head panel 464 (e.g., upper wall), a base panel 466 (e.g., lower wall), opposite the head panel 464 with respect to the vertical axis 104, one or more condensate ports 470 (e.g., drainage ports) fluidly coupled to the base panel 466 and formed therethrough, and one or more flanges 468 (e.g., barrier flanges) extending from the base panel 466 and between the first and second side panels 462, 465. As discussed above, the first and second side panels 462, 465 are configured to enable coupling of the condensate capture receptacle 222 to the heat exchanger 112 (e.g., via the support brackets 226). The shield panel 460, the first and second side panels 462, 465, the base panel 466, and the flange 468 may form a channel 474 (e.g., a basin, a cavity) within the condensate capture receptacle 222 to capture condensate blown off of the heat exchanger 112, 300 by the air flow 114, condensate falling, with respect to the vertical axis 104, from the apex 212, 304 of the heat exchanger 112, 300, condensate flowing along the shield panel 460, the first side panel 462, and/or the second side panel 465, or any combination thereof. In other words, the condensate capture receptacle 222 forms the channel 474 and the flange 468 may retain (e.g., keep) the condensate captured within the channel 474.

Furthermore, the condensate captured may be directed towards the drain pan 220 via the one or more condensate ports 470 (e.g., discharge ports). In particular, the condensate may flow along the channel 474 and into the one or more condensate ports 470, and then the condensate within the one or more condensate ports 470 may be directed by the force of gravity towards the drain pan 220. In some embodiments, and as illustrated in FIG. 8, the one or more condensate ports 470 may be disposed at one or more lateral ends 480 of the channel 474 and/or of the condensate capture receptacle 222. Furthermore, the condensate collection assembly 122 may include a respective discharge conduit 476 fluidly coupled to each of the one or more condensate ports 470. The discharge conduit 476 may extend from the respective condensate port 470 toward the basin 424 of the drain pan 220. For example, each discharge conduit 476 may be a piece of hollow tubing (e.g., plastic tubing, rubber tubing) fitted over a respective open end 478 of the corresponding condensate port 470 to direct condensate from the channel 474 and into the basin 424 of the drain pan 220. While one discharge conduit 476 is shown in FIG. 8, it should be understood that each of the one or more condensate ports 470 may be equipped with a respective discharge conduit 476. In some embodiments, the one or more condensate ports 470 may not be used to direct the condensate towards the drain pan 220. For example, as discussed above, the heat exchanger 112 (e.g., the microchannel heat exchanger 300) may be oriented in a vertical configuration such that condensate may flow downward, with respect to the vertical axis 104, due to the force of gravity to the drain pan 220. In such an implementation, the one or more condensate ports 470 may be capped (e.g., closed off), and the condensate capture receptacle 222 may be utilized to improve heat transfer efficiency of the heat exchanger 112 (e.g., the microchannel heat exchanger 300), as discussed above.

Furthermore, the condensate capture receptacle 222 may be formed from a single continuous piece of material, in some embodiments. For example, the condensate capture receptacle 222 may be formed from a plastic material and may be formed using an injection molding process. In particular, the use of a plastic to form the condensate capture receptacle 222 may improve production cost and, during operation, decrease corrosion of the condensate capture receptacle 222 that may be caused by exposure to condensate (e.g., water). Furthermore, a shape of the condensate capture receptacle 222 may correspond to a geometry (e.g., a shape, a size) of the heat exchanger 112. In particular, a geometry of the condensate capture receptacle 222 may be selected to generally correspond to a shape, geometry, or configuration of the apex 212 of the heat exchanger 112. For example, and with reference to FIG. 6, an angle of the head panel 464 (e.g., relative to the longitudinal axis 102) may correspond to an angle of the first heat exchange portion 206, while an angle of the base panel 466 (e.g., relative to the longitudinal axis 102) may correspond to an angle of the second heat exchange portion 208.

Moreover, a width 472 of the shield panel 460 may correspond to a width of the apex 212, 304 of the heat exchanger 112 (e.g., the microchannel heat exchanger 300). In an installed configuration of the condensate capture receptacle 222 with the heat exchanger 112, the shield panel 460 may be positioned at an offset distance 473 (e.g., a spaced arrangement) from the drain pan 220 along the vertical axis 104. Thus, in the installed configuration, the shield panel 460 may be disposed within the air flow path 110 extending through the housing 108 of the HVAC unit 100, as shown in FIGS. 5 and 6. The shield panel 460 may extend across the air flow path 110 and/or across the apex 212, 304 (e.g., bent portions 302 of the microchannel tubes 308) along the lateral axis 106. More specifically, the shield panel 460 may be positioned within the air flow path 110 downstream of the heat exchanger 112 (e.g., relative to the first direction 116 of the air flow 114), such that the shield panel 460 overlaps with the apex 212, 304 of the heat exchanger 112 (e.g., microchannel heat exchanger 300) with respect to the longitudinal axis 102. The corresponding shape of the condensate capture receptacle 222, along with the adjustable positioning (e.g., mounting, securing) of the condensate capture receptacle 222 to the heat exchanger 112 so that the condensate capture receptacle 222 overlaps with the apex 212, 304 of the heat exchanger 112 (e.g., microchannel heat exchanger 300) and/or the bent portions 302 of the microchannel tubes 308, results in efficient capture of condensate generated by the heat exchanger 112 (e.g., microchannel heat exchanger 300) and improved heat exchange efficiency of the heat exchanger 112 (e.g., microchannel heat exchanger 300). Additionally, the suspended position of the condensate capture receptacle 222 within the air flow path 110 enables reduced restriction of the air flow 114 (e.g., reduced drop in pressure due to blocking at least a portion of the air flow 114) through the air flow path 110 of the HVAC unit 100. Additional features and operation of the condensate capture receptacle 222 is described in further detail below with reference to FIGS. 9 and 10.

Figure 9:
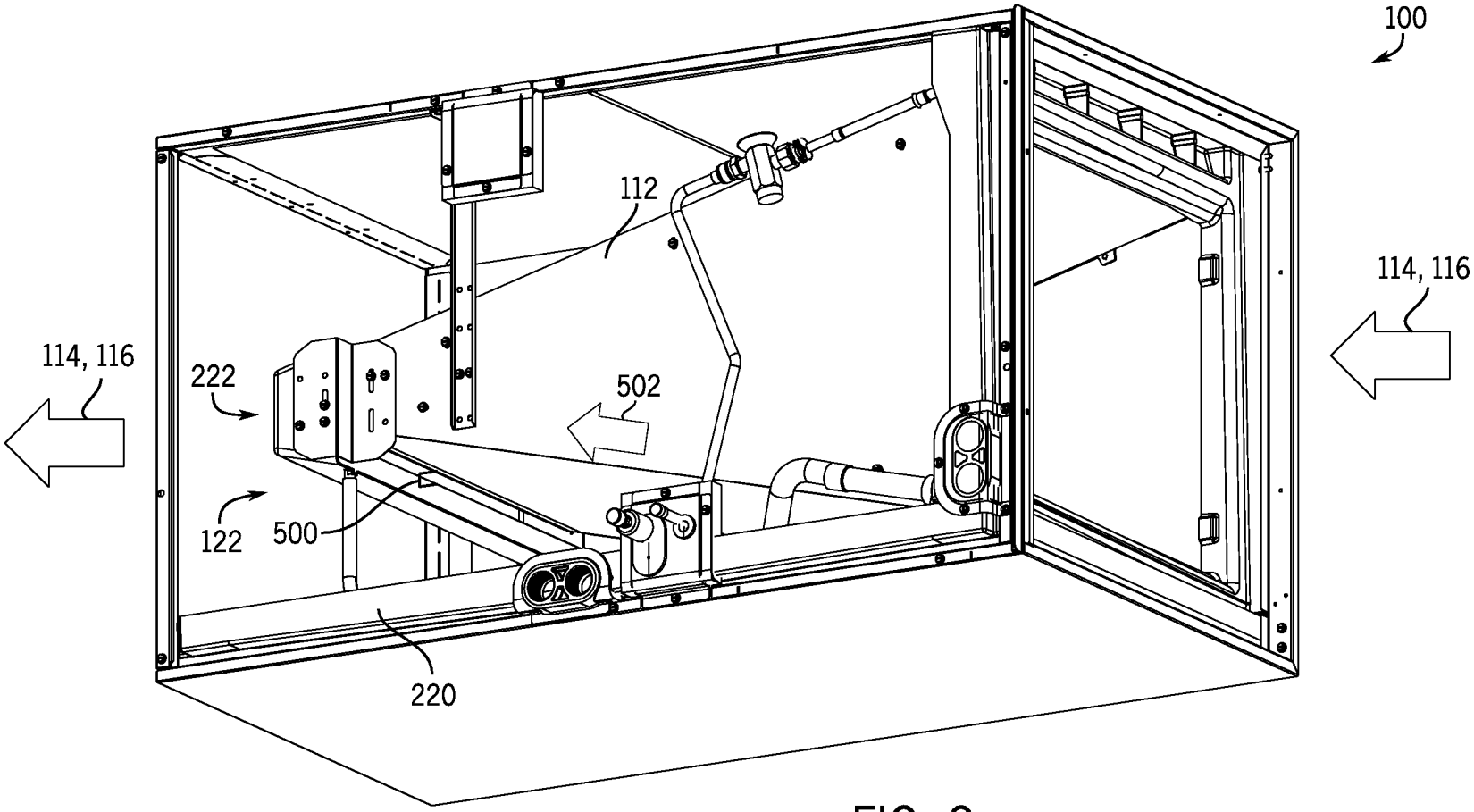
FIG. 9 is a partial perspective view of an embodiment of an HVAC unit including a condensate collection assembly, in accordance with an aspect of the present disclosure.

FIG. 9 is a perspective view of the embodiment of a portion of the HVAC unit 100, illustrating a gap 500 (e.g., an opening) formed between the condensate capture receptacle 222 and the heat exchanger 112 in an installed configuration of the condensate collection assembly 122. In particular, the gap 500 may be formed between the downstream end 210 of the second heat exchange portion 208 of the heat exchanger 112 and the flange 468. During operation, the flange 468 may extend crosswise to the first direction 116 of air flow 114. Furthermore, the gap 500 may enable condensate that may form on the second heat exchange portion 208 of the heat exchanger 112 (e.g., microchannel heat exchanger 300) and that may travel along the second heat exchange portion 208 to the downstream end 210 of the second heat exchange portion 208 to enter the condensate capture receptacle 222. For example, the air flow 114 blowing in the first direction 116 may cause condensate formed on the second heat exchange portion 208 of the heat exchanger 112 (e.g., microchannel heat exchanger 300) to also move (e.g., travel, flow) in the first direction 116, as indicated by arrow 502, and towards the apex 212, 304 and/or downstream end 210 of the heat exchanger 112 (e.g., microchannel heat exchanger 300). The condensate may then enter into and be captured by the condensate capture receptacle 222.

It should be understood that the size of the gap 500 may be any suitable size so as to enable capture of condensate formed on an underside (e.g., with respect to the vertical axis 104) of the heat exchanger 112 (e.g., the microchannel heat exchanger 300) by the condensate capture receptacle 222. In some embodiments, the size of the gap 500 may be selected by adjusting a mounted position (e.g., via the elongated slots 444 of the support brackets 226) of the condensate capture receptacle 222 with respect to the heat exchanger 112 (e.g., the microchannel heat exchanger 300). To this end, the adjustable positioning of the condensate capture receptacle 222 provided by the elongated slots 444 of the support brackets 226 may enable the condensate capture receptacle 222 to maintain the gap 500 at a desired size while also enabling use of the condensate capture receptacle 222 with heat exchangers of varying sizes and/or tonnage. In addition, it should be understood that in some embodiments, an additional gap may be formed on a side of the condensate capture receptacle 222 opposite the gap 500. For example, the additional gap may be formed between the first heat exchange portion 206 of the heat exchanger 112 (e.g., the microchannel heat exchanger 300) and the condensate capture receptacle 222. In some embodiments, the condensate capture receptacle 222 may be mounted to the heat exchanger 112 such that the gap 500 is not formed. Operation of the condensate capture receptacle 222 is described in further detail below with reference to FIG. 10.

Figure 10:
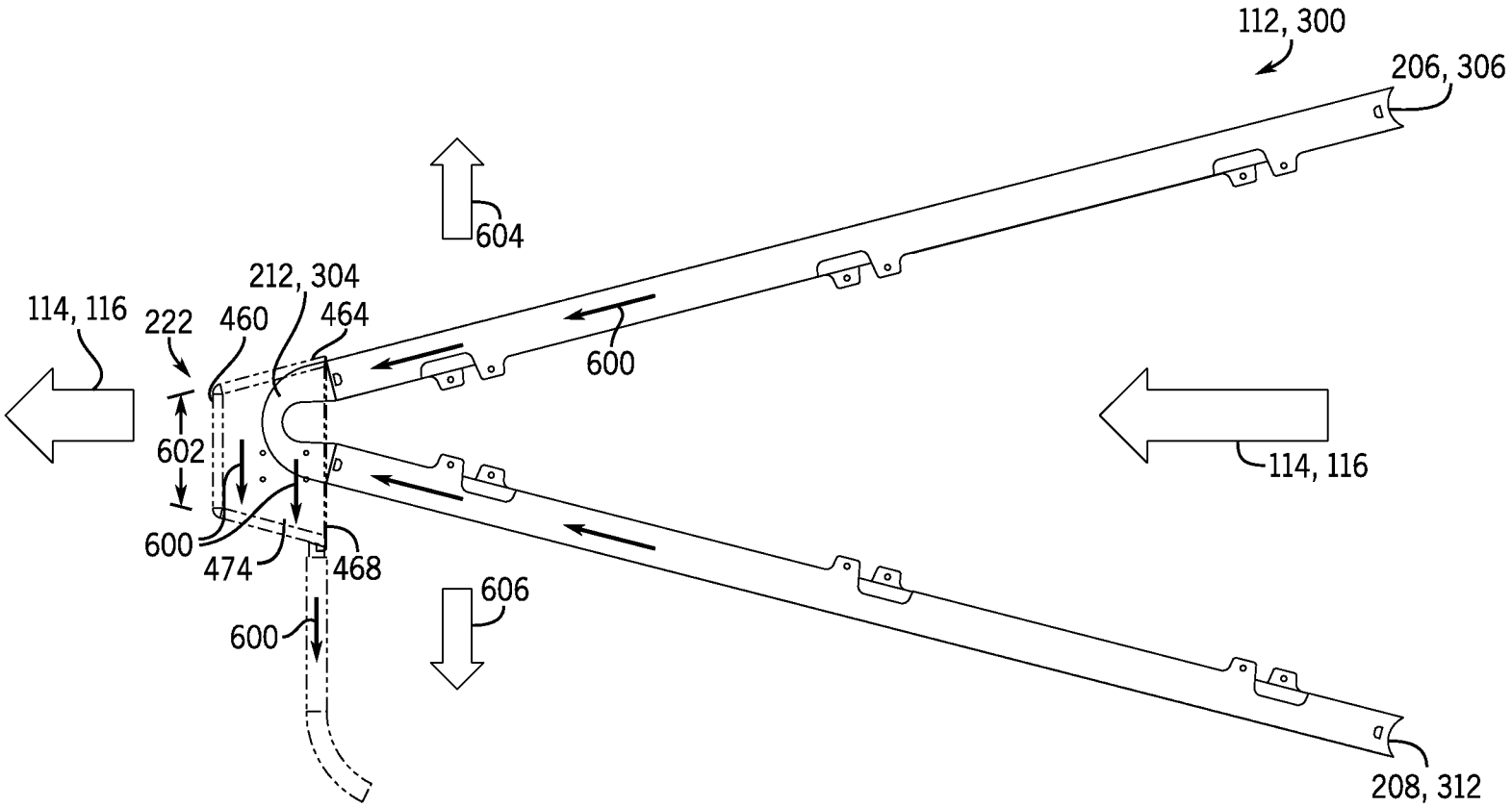
FIG. 10 is a schematic diagram of an embodiment of a condensate collection assembly, illustrating capture of condensate via a condensate capture receptacle, in accordance with an aspect of the present disclosure.

FIG. 10 is a cross-sectional schematic side view of an embodiment of the heat exchanger 112 (e.g., the microchannel heat exchanger 300) and the condensate capture receptacle 222, illustrating capture of condensate 600 dislodged from the heat exchanger 112 (e.g., the microchannel heat exchanger 300) via the air flow 114 traveling in the first direction 116. Specifically, as the air flow 114 flows across and through the heat exchanger 112 (e.g., the microchannel heat exchanger 300) in the first direction 116, condensate 600 may be generated as moisture or water vapor within the air flow 114 condenses. In some instances, the condensate 600 may form and/or accumulate on the first and second heat exchange portions 206, 208 (e.g., on the fins), or the first and second portions 310, 314 of the microchannel tubes 308 (e.g., the fins 328) of the microchannel heat exchanger 300. As previously discussed and further illustrated in FIG. 10, the air flow 114 may force the condensate 600 to travel generally in the first direction 116 and/or along the longitudinal axis 102. For example, the condensate 600 may travel along the fins (e.g., the fins 328) of the first and second heat exchange portions 206, 208 (e.g., the first and second portions 310, 314 of the microchannel tubes 308). Some condensate 600 may ultimately reach one or more of the downstream ends 210 of the heat exchanger 112 (e.g., the microchannel heat exchanger 300) and may be dislodged from the heat exchanger 112 (e.g., the microchannel heat exchanger 300). The force of the air flow 114 may carry the condensate 600 from the downstream ends 210 of the heat exchanger 112 (e.g., the microchannel heat exchanger 300). In some embodiments, the force of the air flow 114 may carry the condensate 600 from the bent portions 302 of the microchannel tubes 308 of the microchannel heat exchanger 300. In any case, subsequently, the condensate 600 carried by the air flow 114 may contact the condensate capture receptacle 222 via the shield panel 460, the first side panel 462, the second side panel 465, the head panel 464, the base panel 466, or any combination thereof. The captured condensate 600 may then be captured and collected within the channel 474 of the condensate capture receptacle 222.

As discussed above, the condensate capture receptacle 222 may also block and/or redirect one or more portions, as indicated by arrows 604, 606, of the air flow 114 traveling across the apex 212, 304 of the heat exchanger 112 (e.g., the microchannel heat exchanger 300). The redirected air flow portions indicated by arrows 604, 606 may instead flow across the heat exchanger 112 at the first and/or second heat exchange portions 206, 208 of the heat exchanger 112 (e.g., the first and/or second portions 310, 314 of the microchannel heat exchanger 300). Further, as discussed above, including the condensate capture receptacle 222 with the heat exchanger 112 (e.g., the microchannel heat exchanger 300) may increase the overall heat transfer of the heat exchanger 112 by causing a greater percentage of the air flow 114 to travel across (e.g., interact with) finned portions of the heat exchange coils or tubes (e.g., the first and/or second heat exchange portions 206, 208, the first and/or second portions 310, 314) by blocking the air flow 114 from exiting the heat exchanger 112 via the fin-less portion of heat exchange coils or tubes (e.g., bent portions 302 at the apex 212, 304). Thus, the condensate capture receptacle 222 may improve the performance of the heat exchanger 112 (e.g., the microchannel heat exchanger 300) during operation in addition to efficiently and effectively capturing condensate generated by the heat exchanger 112.

In some embodiments, a portion or an entirety of the condensate capture receptacle 222 may be formed from a material that is generally or substantially impervious to water or liquid, but enables transmission of at least a portion of the air flow 114 therethrough. In another embodiment, a portion or an entirety of the condensate capture receptacle 222 may be formed from a material that blocks flow of both liquid and gas therethrough. In any case, the condensate 600 that impinges against the condensate capture receptacle 222 is diverted downwards, due to gravity, along a height 602 of the condensate capture receptacle 222 towards the channel 474.

FIGS. 11-14 illustrate view of an alternative embodiment of the condensate collection assembly 122, in accordance with the presently disclosed techniques. In particular, the condensate capture receptacle 222 shown in FIGS. 11-13 and the support brackets 226 shown in FIG. 14 may provide additional adjustability to enable the condensate collection assembly 122 to be used in an installed configuration with heat exchangers 112 (e.g., microchannel heat exchangers 300) that may vary in shape, geometry, size, capacity, or other aspects. For example, the condensate collection assembly 122 may be used with heat exchangers 112 that vary in a height 700 of the apex 304, where the height 700 of the apex 304, as shown in FIG. 6, may be measured from a lower most point 702, with respect to the vertical axis 104, of the respective downstream end 210, with respect to the first direction 116 of air flow 114, of the second heat exchange portion 208 to an upper most point 704 of the respective downstream end 210 of the first heat exchange portion 206.

Figure 11:
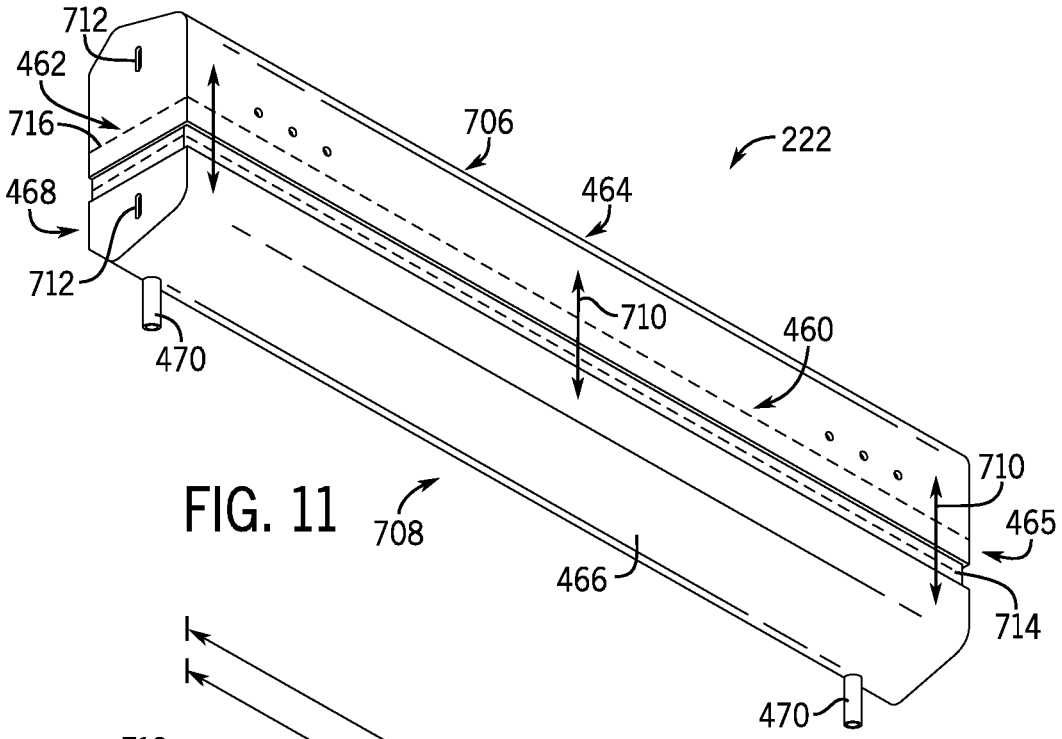
FIG. 11 is a perspective view of an embodiment of a condensate capture receptacle, in accordance with an aspect of the present disclosure.

FIG. 11 is a perspective view of an embodiment of the condensate capture receptacle 222, illustrating a multi-component configuration of the condensate capture receptacle 222. In other words, the condensate capture receptacle 222 of the illustrated embodiment is not a single, integrally formed piece. In some embodiments, the condensate capture receptacle 222 may include a first translational piece 706 and a second translational piece 708. The first and second translational pieces 706, 708 may have complementary geometries such that the first translational piece 706 may translate (e.g., telescope, extend out, slide, move) along the second translational piece 708, and/or vice versa, as indicated by arrows 710. In particular, as illustrated, at least a portion of the second translational piece 708 may define a second partial perimeter 714 smaller than a first partial perimeter 716 of the first translational piece 706. In this way, at least a portion of the second translational piece 708 may fit or extend within the first translational piece 706. Thus, when the first and/or second translational pieces 706, 708 are translated along or relative to one another, at least a portion of the second translational piece 708 is retained within the first translational piece 706. While FIG. 11 shows the first translational piece 706 with the first partial perimeter 716 larger than the second partial perimeter 714 of the second translational piece 708, and the first translational piece 706 enclosing at least a portion of the second translational piece 708, it should be understood that in some embodiments, at least a portion of the first translational piece 706 may have a partial perimeter smaller than a partial perimeter of the second translational piece 708. In such an embodiment, when the first and/or second translational pieces 706, 708 are translated relative to one another, at least a portion of the first translational piece 706 may be retained within the second translational piece 708.

In addition, as discussed above, the condensate capture receptacle 222 may include the shield panel 460 (e.g., condensate barrier, capture panel, blocking plate), the first side panel 462 (e.g., on the first lateral side 450), the second side panel 465 (e.g., on the second lateral side 452), the head panel 464, the base panel 466 opposite the head panel 464, with respect to the vertical axis 104, the one or more condensate ports 470 (e.g., drainage ports) fluidly coupled to the base panel 466 and formed therethrough, and the one or more flanges 468 (e.g., barrier flanges) extending from the base panel 466 and between the first and second side panels 462, 465. Furthermore, as shown in the illustrated embodiment, the first and second side panels 462, 465 may include one or more elongated slots 712 formed therethrough. In particular, the one or more elongated slots 712 may enable adjustability of a mounting position of the condensate capture receptacle 222 relative to the heat exchanger 112.

Figure 12:
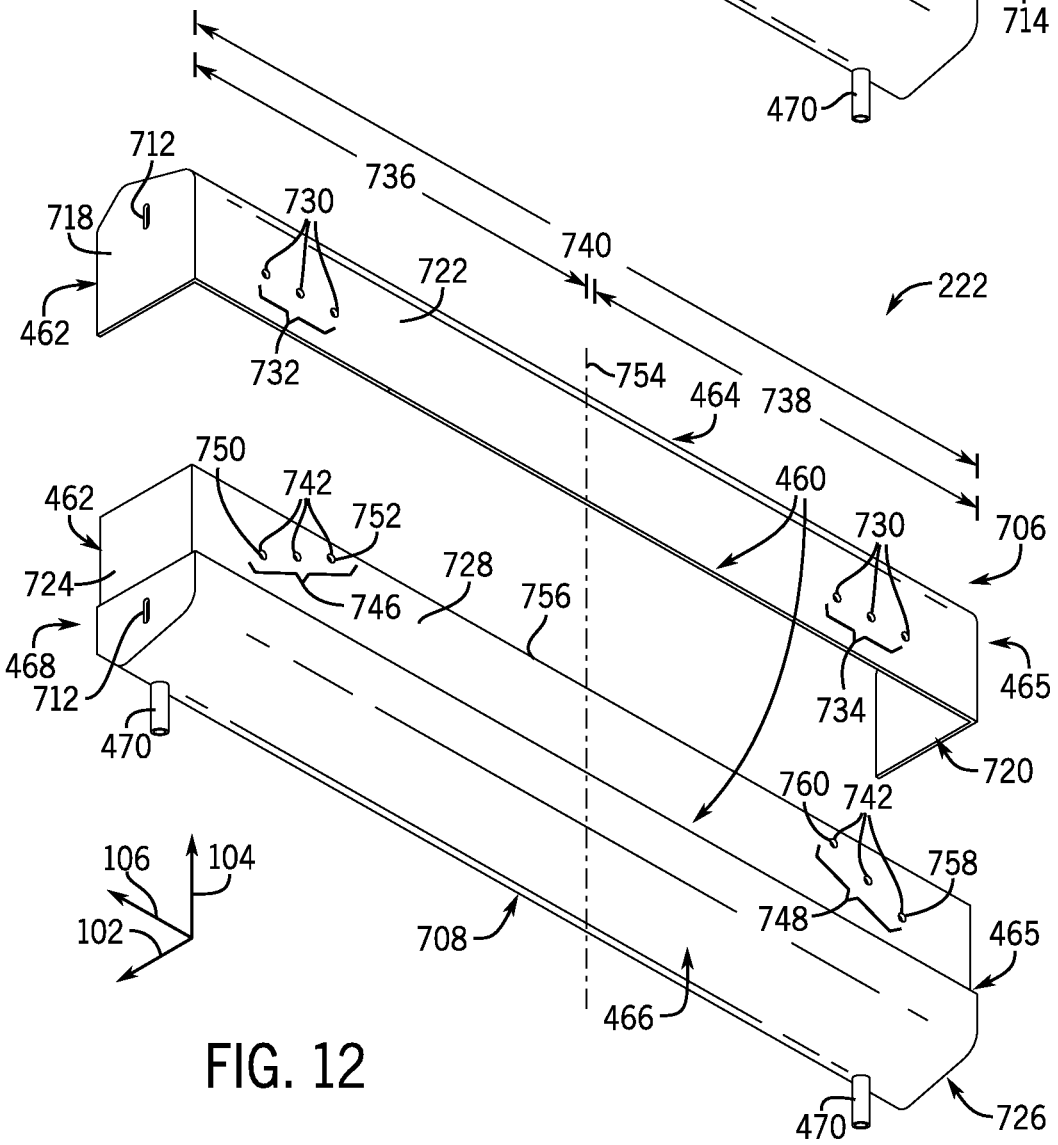
FIG. 12 is an exploded perspective view of an embodiment of a condensate capture receptacle, in accordance with an aspect of the present disclosure.

Furthermore, FIG. 12 is an exploded perspective view of the condensate capture receptacle 222 having a multi-component configuration. In particular, the first translational piece 706 may be formed of and include a first section 718 of the first side panel 462, a first section 720 of the second side panel 465, the head panel 464, and a first section 722 of the shield panel 460. Moreover, the second translational piece 708 may be formed of and include a second section 724 of the first side panel 462, a second section 726 of the second side panel 465, the base panel 466, the one or more condensate ports 470 fluidly coupled to the base panel 466, the one or more flanges 468 extending from the base panel 466 and between the second section 724 of the first side panel 462 and second section 726 of the second side panel 465, and a second section 728 of the shield panel 460. As illustrated, the first section 722 of the shield panel 460 includes one or more first holes 730 extending therethrough and arranged with a first set 732 of the one or more first holes 730 positioned within a first portion 736 of a total length 740 of the condensate capture receptacle 222, and a second set 734 of the one or more first holes 730 positioned within a second portion 738 of the total length 740. Specifically, in the illustrated embodiment, the first and second sets 732, 734 of the one or more first holes 730 are aligned with one another relative to the lateral axis 106. In addition, the second section 728 of the shield panel 460 includes one or more second holes 742 extending therethrough and arranged with a first set 746 of the one or more second holes 742 positioned within the first portion 736 of the total length 740 of the condensate capture receptacle 222, and a second set 748 of the one or more second holes 742 positioned within the second portion 738 of the total length 740. In particular, in the illustrated embodiment, the first and second sets 746, 748 of the one or more second holes 742 are aligned with one another at an angle relative to the lateral axis 106. In other words, each consecutive hole of the first set 746 of the one or more second holes 742, starting from a first distal hole 750 and ending with a first proximal hole 752 with respect to a center 754 of the condensate capture receptacle 222, decreases in a respective distance from a top edge 756 of the second section 728 of the shield panel 460. In the same way, each consecutive hole of the second set 748 of the one or more second holes 742, starting from a second distal hole 758 and ending with a second proximal hole 760 with respect to the center 754, decreases in a respective distance from the top edge 756 of the second section 728 of the shield panel 460.

Figure 13:
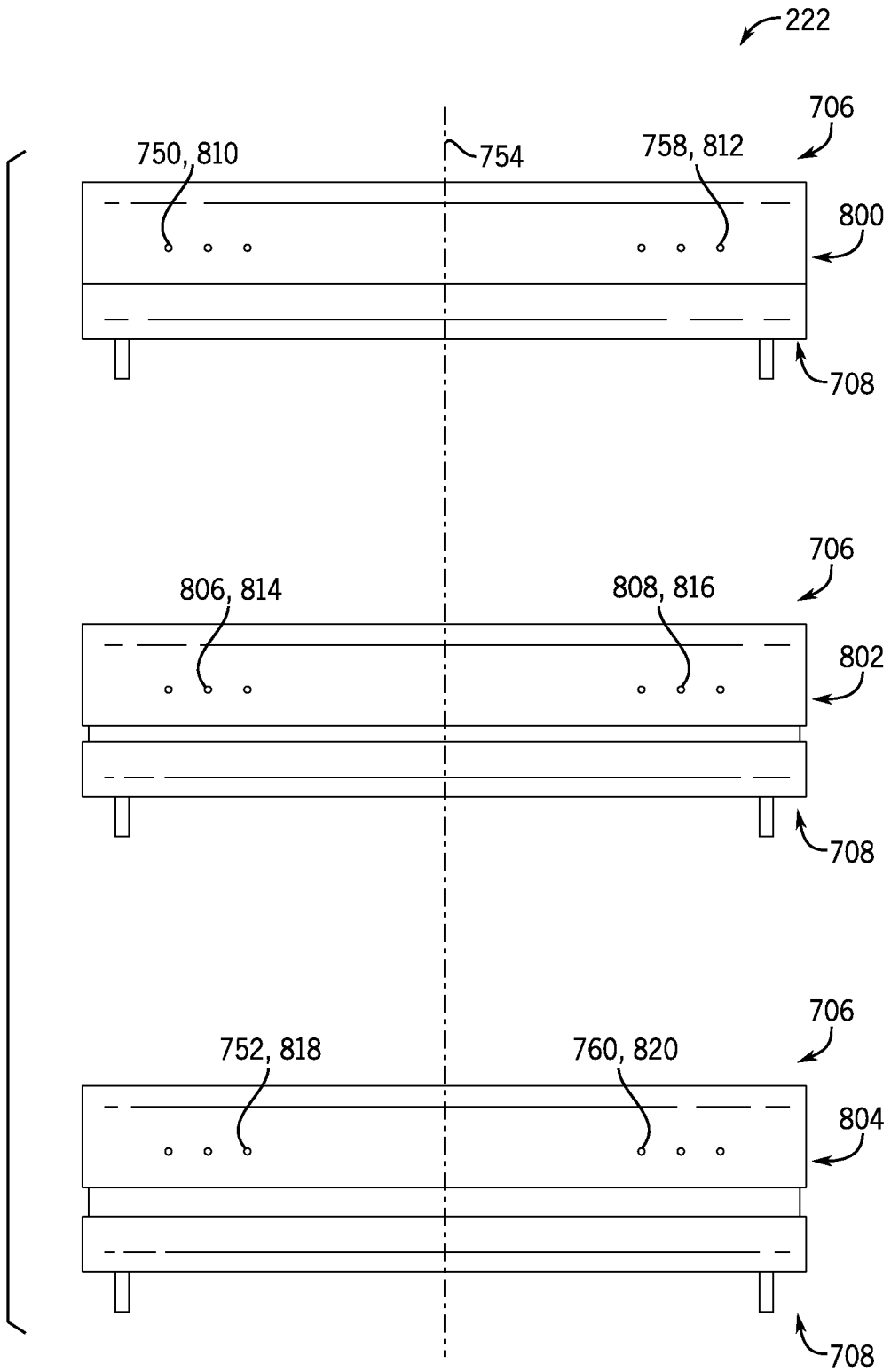
FIG. 13 illustrates side views of embodiments of a condensate capture receptacle, in accordance with an aspect of the present disclosure.

The angled arrangement of the first and second sets 746, 748 of the one or more second holes 742 enables the first translational piece 706 to be secured (e.g., attached, fastened, connected) to the second translational piece 708 at multiple different extension (e.g., height, translational) arrangements (e.g., configurations), which enables formation of the condensate capture receptacle 222 in varying sizes (e.g., shapes). As discussed above, the size adjustability of the condensate capture receptacle 222 enables the condensate capture receptacle 222 to overlap with the apex 212, 304 of different heat exchangers (e.g., microchannel heat exchangers) of varying sizes. For example, FIG. 13 illustrates side views of three extension arrangements of the first translational piece 706 in relation to the second translational piece 708 of the condensate capture receptacle 222. In particular, a first extension arrangement 800 of the condensate capture receptacle 222 may include the first translational piece 706 and the second translational piece 708 positioned relative to one another such that the first and second distal most holes 750, 758 of the second translational piece 708 align respectively with a first and second distal holes 810, 812, with respect to the center 754, of the first and second sets 732, 734 of the one or more first holes 730 of the first translational piece 706. In the first extension arrangement 800, the first and second translational pieces 706, 708 may be fastened together by extending a fastener (e.g., a screw, a pin) through each respective alignment of the first distal hole 750 of the first set 746 of the one or more second holes 742 with the distal hole 810 of the first set 732 of the one or more first holes 730 and the second distal hole 758 of the second set 748 of the one or more second holes 742 with the second distal hole 812 of the second set 734 of the one or more first holes 730.

In addition, in the illustrated embodiment, the first translational piece 706 and the second translational piece 708 may be positioned relative to one another in a second extension arrangement 802 of the condensate capture receptacle 222. The second extension arrangement 802 includes the first translational piece 706 and the second translational piece 708 arranged such that a first and second middle holes 806, 808 of the second translational piece 708 align respectively with a first and second middle hole 814, 816 of the first and second sets 732, 734 of the one or more first holes 730 of the first translational piece 706. In the second extension arrangement 802, the first and second translational pieces 706, 708 may be fastened together by extending a fastener (e.g., a screw, a pin) through each respective alignment of the first middle hole 806 of the first set 746 of the one or more second holes 742 with the first middle hole 814 of the first set 732 of the one or more first holes 730 and the second middle hole 808 of the second set 748 of the one or more second holes 742 with the second middle hole 816 of the second set 734 of the one or more first holes 730.

Furthermore, for the illustrated embodiment, a third extension arrangement 804 of the condensate capture receptacle 222 may include the first translational piece 706 and the second translational piece 708 positioned relative to one another such that the first and second proximal holes 752, 760 of the second translational piece 708 align respectively with a first and second proximal hole 818, 820, with respect to the center 754, of the first and second sets 732, 734 of the one or more first holes 730 of the first translational piece 706. In the third extension arrangement 804, the first and second translational pieces 706, 708 may be fastened together by extending a fastener (e.g., a screw, a pin) through each respective alignment of the first proximal hole 752 of the first set 746 of the one or more second holes 742 with the proximal hole 818 of the first set 732 of the one or more first holes 730 and the second proximal hole 760 of the second set 748 of the one or more second holes 742 with the second proximal hole 820 of the second set 734 of the one or more first holes 730.

It should be appreciated that while FIG. 13 illustrates three extension arrangements (e.g., the first, second, and third extension arrangements 800, 802, 804) of the first and second translational pieces 706, 708, and further two sets (e.g., the first and second sets 732, 734 of the one or more first holes 730) of three holes extending through the first translational piece 706 and a corresponding two sets (e.g., the first and second sets 746, 748 of the one or more second holes 742) of three holes extending through the second translational piece 708, the first and/or the second translational pieces 706, 708 may include any number of sets (e.g., 1 set, 3 sets, 4 sets, etc.) of any number of holes (e.g., 1 hole, 2 holes, 4 holes, 5 holes, etc.) such that the first and the second translational pieces 706, 708 may be positioned relative to one another in any number of extension arrangements (e.g., 2, 4, 5, 6, etc.).

Figure 14:
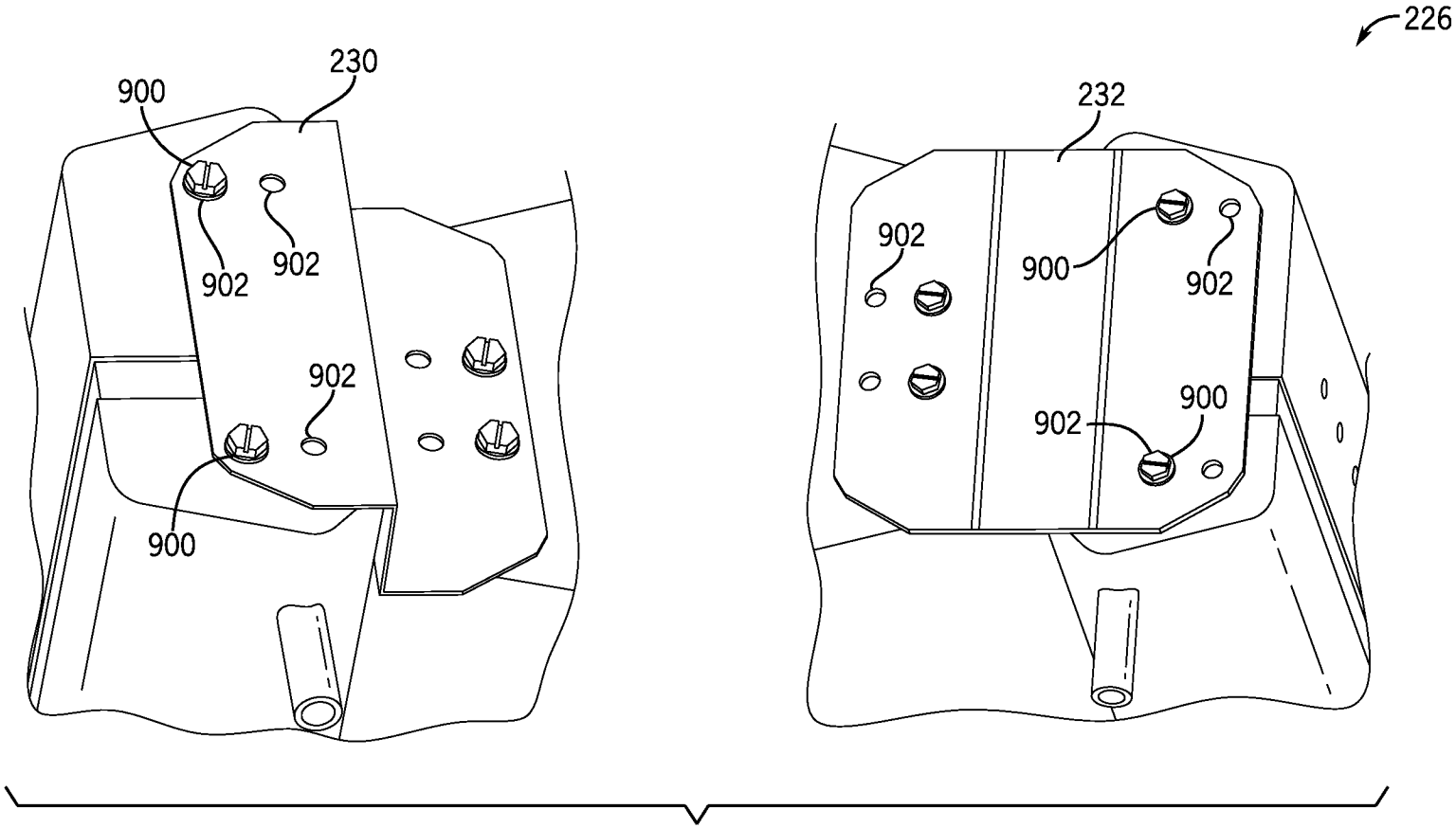
FIG. 14 illustrates partial perspective views of embodiments of the condensate collection assembly, illustrating support brackets coupled to condensate capture receptacles, in accordance with an aspect of the present disclosure.

FIG. 14 is a perspective view of an embodiment of the support brackets 226 of the condensate capture receptacles 222. In particular, as discussed above, the support brackets 226 may couple (e.g., directly couple) the condensate capture receptacle 222 to the heat exchanger 112 (e.g., the microchannel heat exchanger 300) and position the condensate capture receptacle 222 such that the condensate capture receptacle 222 overlaps with (e.g., encloses, captures) the apex 212, 304 of the heat exchanger 112 (e.g., the microchannel heat exchanger 300). Furthermore, the support brackets 226 may support and suspend the condensate capture receptacle 222 above the drain pan 220 relative to the vertical axis 104. In particular, with additional reference to FIG. 6, the condensate capture receptacle 222 may extend from the first support bracket 230 to the second support bracket 232 and across the air flow path 110 of the air flow 114. In addition, the support brackets 226 may couple the condensate capture receptacle 222 to the heat exchanger 112 (e.g., the microchannel heat exchanger 300), despite a variation in size (e.g., shape) of the condensate capture receptacle 222 and/or the heat exchanger 112 (e.g., the microchannel heat exchanger 300, the apex 212, 304 of the heat exchanger/microchannel heat exchanger 112, 300). For example, and with additional reference to FIGS. 11 and 12, the condensate capture receptacle 222 includes the one or more elongated slots 712 extending through the first and second side panels 462, 465. As in the illustrated embodiment, the first section 718 and the second section 724 of the first side panel 462 may each include an elongated slot 712, and the first section 720 and the second section 726 of the second side panel 465 may additionally each include an elongated slot 712. In this way, the same support brackets 226 may couple (e.g., fastened) to the condensate capture receptacle 222 in a variety of extension arrangements (e.g., the first, second, and/or third extension arrangements 800, 802, 804). Moreover, one or more fasteners 900 may extend through the alignment of one or more holes 902 extending through the support brackets 226 and the one or more elongated slots 712 of the condensate capture receptacle 222 to secure the support brackets 226 to the condensate capture receptacle 222.

As set forth above, embodiments of the present disclosure may provide one or more technical effects useful for efficiently capturing and/or collecting condensate that forms and/or accumulates on a heat exchanger and is dislodged from the heat exchanger by an air flow directed across the heat exchanger (e.g., in a generally horizontal direction). In particular, the condensate collection assembly discussed herein is configured to capture condensate, including condensate blowoff, that may be generated during operation of the heat exchanger, as well as provide improved heat exchange efficiency for the heat exchanger in an HVAC unit. It should be understood that the technical effects and technical problems in the specification are examples and are not limiting. Indeed, it should be noted that the embodiments described in the specification may have other technical effects and can solve other technical problems.

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure.

Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A condensate collection assembly, comprising:

a drain pan configured to collect condensate generated by a heat exchanger of a heating, ventilation, and air conditioning (HVAC) system; and a condensate capture receptacle configured to discharge condensate to the drain pan, wherein the condensate capture receptacle comprises a first translational piece and a second translational piece, the first translational piece and the second translational piece are configured to overlap with the heat exchanger relative to a direction of air flow across the heat exchanger, are configured to couple to the heat exchanger, and are configured to be suspended above the drain pan relative to a direction of gravity, and the first translational piece is adjustable relative to the second translational piece.

2. The condensate collection assembly of claim 1, wherein the first translational piece and the second translational piece define a cavity configured to capture condensate dislodged from the heat exchanger by the air flow.

3. The condensate collection assembly of claim 1, comprising a support bracket configured to couple the first translational piece and the second translational piece to the heat exchanger.

4. The condensate collection assembly of claim 3, wherein the support bracket is a first support bracket, and the condensate collection assembly comprises a second support bracket configured to couple to the first translational piece and the second translational piece to the heat exchanger.

5. The condensate collection assembly of claim 4, wherein the first translational piece and the second translational piece are configured to extend from the first support bracket to the second support bracket and across an air flow path of the air flow.

6. The condensate collection assembly of claim 1, wherein the condensate capture receptacle is configured to couple to a downstream end of the heat exchanger, relative to the direction of air flow.

7. The condensate collection assembly of claim 1, wherein the second translational piece comprises a barrier flange configured to extend along the heat exchanger in a direction crosswise to the direction of air flow such that an opening is formed between the barrier flange and the heat exchanger in an installed configuration of the condensate capture receptacle.

8. The condensate collection assembly of claim 1, wherein the second translational piece defines a channel formed at a base of the second translational piece, wherein the channel is configured to direct condensate captured by the condensate capture receptacle toward the drain pan.

9. The condensate collection assembly of claim 8, wherein the drain pan defines a basin configured to collect condensate generated by the heat exchanger, and the condensate capture receptacle comprises a discharge port configured to discharge condensate from the channel to the basin.

10. The condensate collection assembly of claim 9, comprising a discharge conduit configured to be fluidly coupled to the discharge port, wherein the discharge conduit is configured to extend from the discharge port toward the basin and to direct condensate from the discharge port into the basin.

11. The condensate collection assembly of claim 1, wherein the first translational piece is configured to couple to the second translational piece in a plurality of extension arrangements, and wherein a first size of the condensate capture receptacle in a first extension arrangement of the plurality of extension arrangements is smaller than a second size of the condensate capture receptacle in a second extension arrangement of the plurality of extension arrangements.

12. A condensate collection system, comprising:

a condensate trough configured to couple to a downstream end of a heat exchanger disposed within an air flow path of a heating, ventilation, and air conditioning (HVAC) system, relative to a direction of air flow across the heat exchanger, wherein the condensate trough is configured to capture condensate generated by the heat exchanger and is configured to be disposed offset from a drain pan of the HVAC system, the condensate trough comprises a first translational piece and a second translational piece, the first translational piece and the second translational piece are configured to overlap with the downstream end of the heat exchanger relative to the direction of air flow across the heat exchanger, are configured to couple to the heat exchanger, and are configured to be suspended above the drain pan relative to a direction of gravity, and the first translational piece is adjustable relative to the second translational piece.

13. The condensate collection system of claim 12, comprising the drain pan, wherein the drain pan is configured to be positioned beneath the heat exchanger relative to the direction of gravity.

14. The condensate collection system of claim 13, wherein the drain pan comprises a base and a plurality of walls extending from the base to define an outer perimeter of the drain pan, wherein the condensate trough is configured to be disposed internal to the outer perimeter.

15. The condensate collection system of claim 12, comprising at least one bracket configured to couple to the heat exchanger and to the first translational piece and the second translational piece to secure the first translational piece and the second translational piece to the heat exchanger.

16. The condensate collection system of claim 12, wherein the second translational piece comprises a basin configured to capture condensate dislodged from the heat exchanger by an air flow and a discharge port configured to direct condensate from the basin toward the drain pan, and wherein the condensate collection system comprises a discharge conduit configured to fluidly couple to the discharge port and extend from the condensate trough toward the drain pan, wherein the discharge conduit is configured to direct condensate from the discharge port into the drain pan.

17. The condensate collection system of claim 12, wherein the first translational piece is configured to couple to the second translational piece in a plurality of translational arrangements, and wherein a first size of the condensate trough in a first translational arrangement of the plurality of translational arrangements is smaller than a second size of the condensate trough in a second translational arrangement of the plurality of translational arrangements.

18. A heating, ventilation, and air conditioning (HVAC) system, comprising:

a heat exchanger disposed within an air flow path and configured to condition an air flow directed across the heat exchanger; and a condensate collection assembly configured to capture condensate generated by the heat exchanger and to discharge condensate to a drain pan disposed beneath the heat exchanger relative to a direction of gravity, wherein the condensate collection assembly comprises:

a first translational piece; and a second translational piece coupled to the first translational piece, wherein the first translational piece and the second translational piece are configured to overlap with the heat exchanger relative to a direction of air flow across the heat exchanger along the air flow path, are configured to couple to the heat exchanger, and are configured to be suspended above the drain pan relative to the direction of gravity, and the first translational piece is adjustable relative to the second translational piece.

19. The HVAC system of claim 18, wherein the heat exchanger is a microchannel heat exchanger comprising microchannel tubes, a first portion of the microchannel tubes comprises a first set of fins, a second portion of the microchannel tubes comprises a second set of fins, the microchannel tubes comprise a bend between first portion and the second portion, and the first translational piece and the second translational piece are configured to overlap with the bend of the microchannel tubes relative to the direction of air flow across the heat exchanger.

20. The HVAC system of claim 18, comprising the drain pan, wherein the second translational piece defines a basin configured to capture condensate and a discharge port configured to direct condensate from the basin toward the drain pan, and wherein the condensate collection assembly comprises a discharge conduit configured to fluidly couple to the discharge port and extend from the second translational piece toward the drain pan at least partially along the direction of gravity, wherein the discharge conduit is configured to direct condensate from the discharge port into the drain pan.

* * * * *